US005518382A

United States Patent [19]

Gennaro

[11] Patent Number: 5,518,382

[45] Date of Patent: May 21, 1996

[54] TWIN ROTOR EXPANSIBLE/CONTRACTIBLE CHAMBER APPARAUTS

[76] Inventor: Mark A. Gennaro, 27795 Abadejo, Mission Viejo, Calif. 92692

[21] Appl. No.: 220,201

[22] Filed: Mar. 30, 1994

Related U.S. Application Data

[63] Continuation-in-part of Ser. No. 95,413, Jul. 22, 1993, Pat. No. 5,466,138.

[51] Int. Cl.[6] ..... F01C 21/00

[52] U.S. Cl. ..... 418/188; 418/206

[58] Field of Search ..... 418/188, 205, 418/206

[56] References Cited

U.S. PATENT DOCUMENTS

| | | | |
|---|---|---|---|
| 213,885 | 4/1879 | Fox | 418/188 |
| 516,385 | 3/1894 | Weston | 418/188 |
| 864,889 | 9/1907 | Edwards | 418/191 |
| 2,724,340 | 11/1955 | Tryhorn | 418/206 |
| 3,499,425 | 3/1970 | Gommel . | |
| 3,517,651 | 6/1970 | Graybill . | |
| 3,538,893 | 11/1970 | Tinsley . | |
| 3,596,641 | 8/1971 | Hofmann . | |
| 3,601,514 | 8/1971 | Afner | 418/191 |
| 3,871,337 | 3/1975 | Green et al. . | |
| 3,886,763 | 6/1975 | Edwards . | |
| 3,886,909 | 6/1975 | Balsbaugh . | |
| 3,945,777 | 3/1976 | Labus | 418/206 |
| 4,038,948 | 8/1977 | Blackwood . | |
| 4,077,365 | 3/1978 | Schlueter . | |
| 4,106,443 | 8/1978 | Triulzi . | |
| 4,401,062 | 8/1983 | Dean . | |
| 4,417,859 | 11/1983 | Praner | 418/191 |
| 4,464,102 | 8/1984 | Eiermann | 418/191 |
| 4,561,836 | 12/1985 | Wankel | 418/191 |
| 4,879,979 | 11/1989 | Tiguero . | |

FOREIGN PATENT DOCUMENTS

| | | | |
|---|---|---|---|
| 0088991 | 4/1991 | Japan | 418/191 |
| 0248713 | 1/1967 | U.S.S.R. | 418/188 |

*Primary Examiner*—Charles Freay

*Attorney, Agent, or Firm*—K. David Crockett; Crockett & Fish; Richard L. Myers

[57] ABSTRACT

Apparatus defining an expansible/contractible chamber includes a housing having a first housing portion and a second housing portion. A rotor rotates within the first housing portion in one direction while a block rotates in the second housing portion in an opposite direction. A vane disposed on the rotor registers with a recess in the block and defines with the block the chamber. The apparatus can function as an engine, a turbine, a pump, a compressor, or a vacuum pump. An associated method includes the steps of introducing a fluid into the chamber, rotating the rotor and associated vane in order to vary the volume of the chamber and performing work relative to the fluid in the chamber.

2 Claims, 14 Drawing Sheets

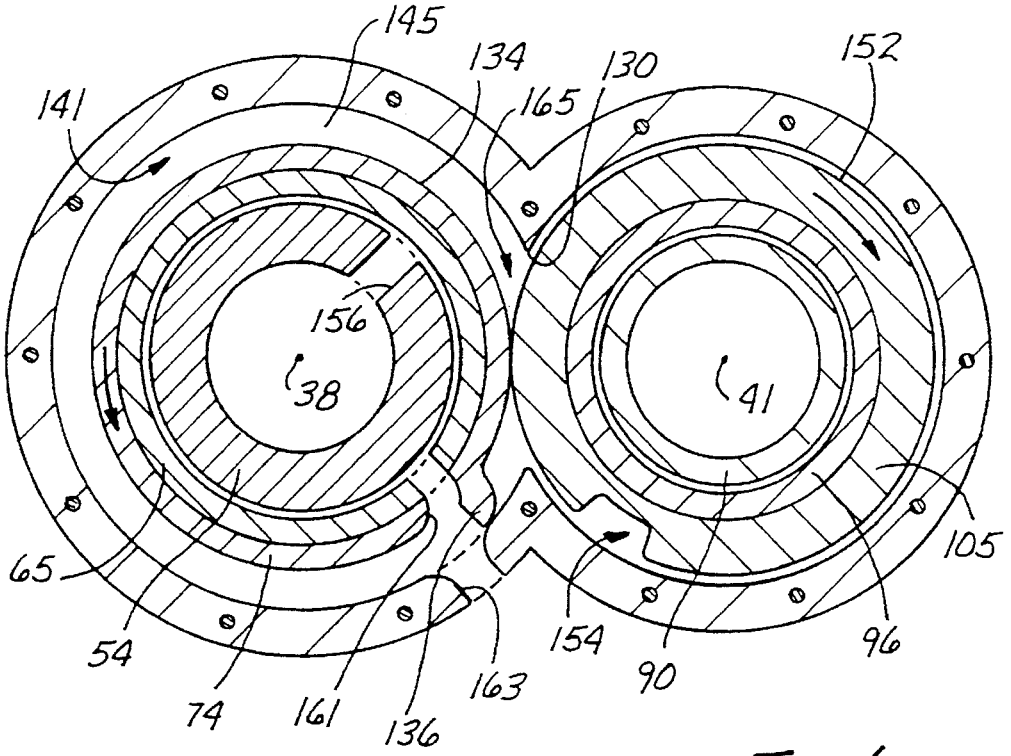
Fig. 6
Fig. 7
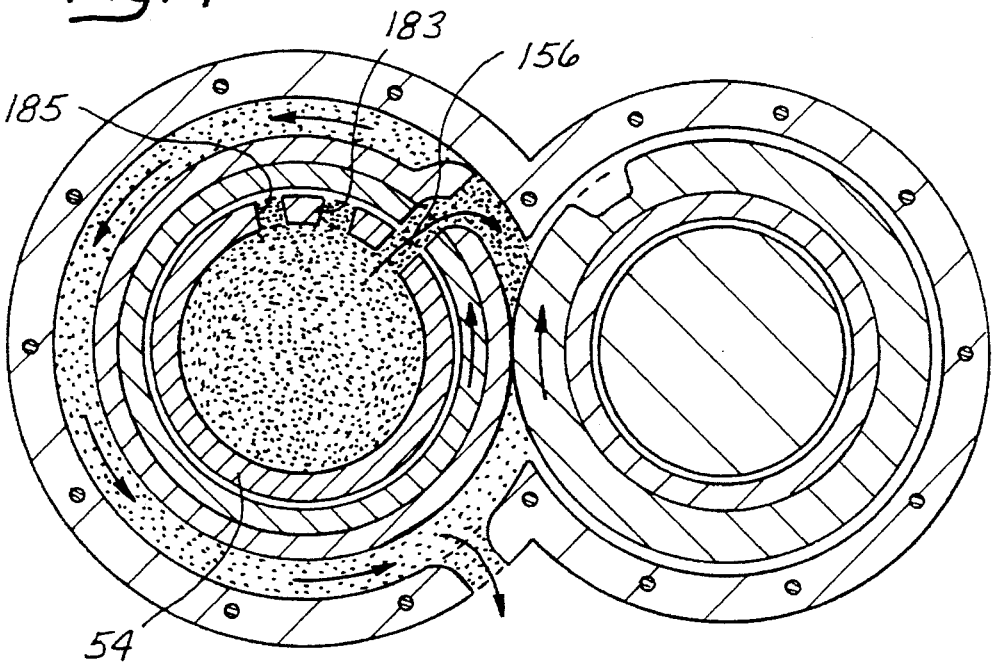

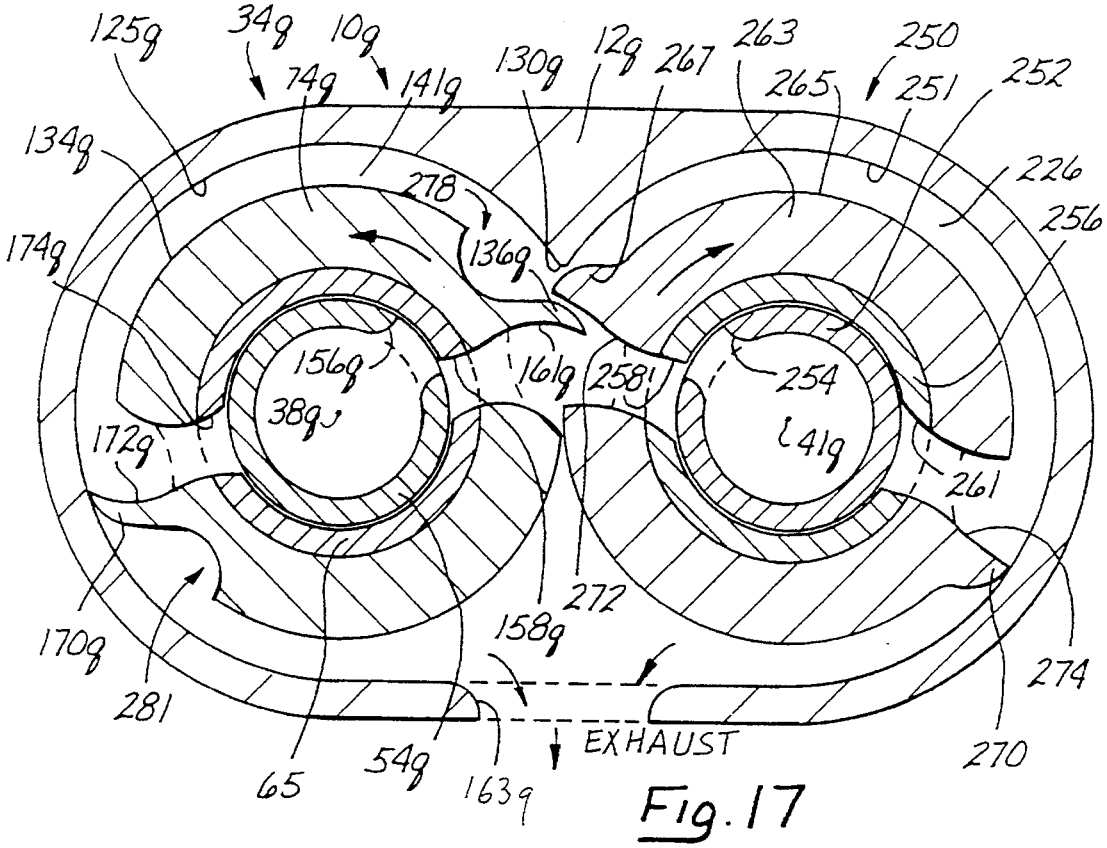
Fig. 17
Fig. 18
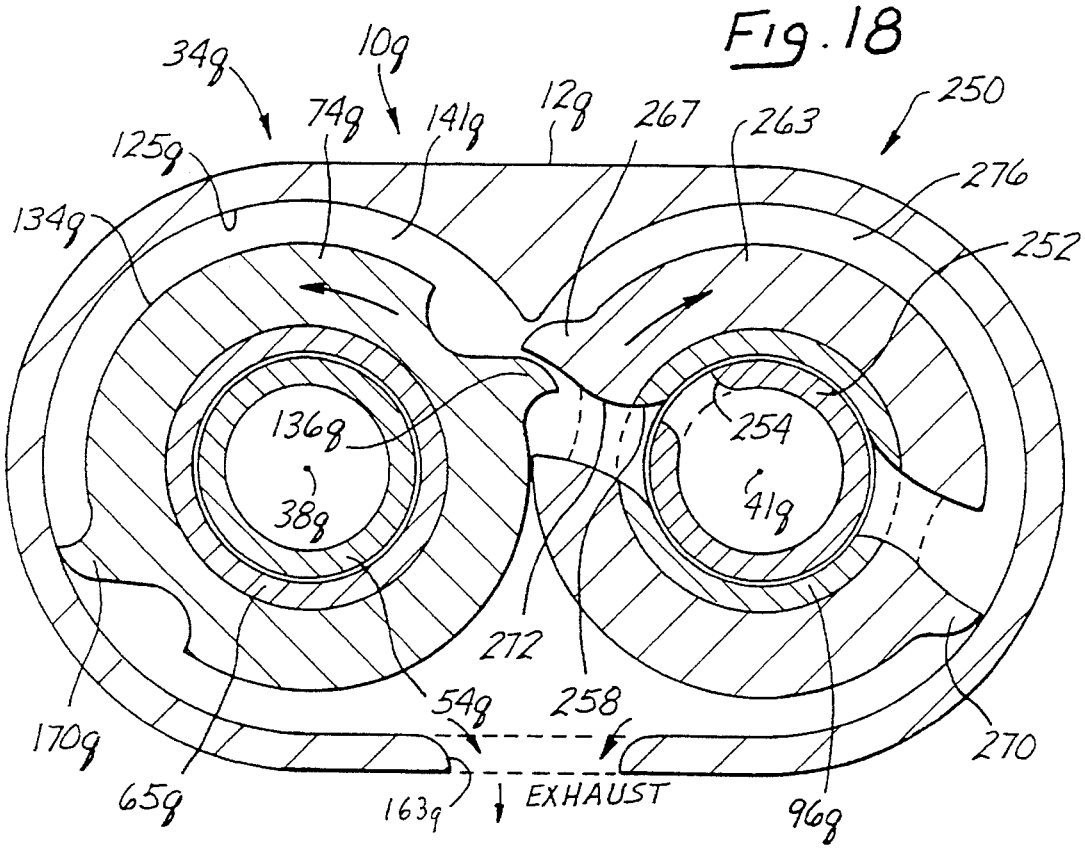

TWIN ROTOR EXPANSIBLE/CONTRACTIBLE CHAMBER APPARAUTS

CROSS REFERENCE TO RELATED APPLICATION

This application is a continuation-in-part of U.S. patent application Ser. No. 08/095,413 filed on Jul. 22, 1993, now U.S. Pat. No. 5,466,138, and entitled Expansible and Contractible Chamber Assembly and Method.

BACKGROUND OF THE INVENTION

1. Field of the Invention

This invention relates generally to engines, pumps, compressors and vacuum apparatus having expansion or compression chambers which perform work relative to a fluid medium.

2. Discussion of the Prior Art

Expansion or compression chambers are commonly found in engines, pumps, compressors and vacuum apparatus which typically receive a fluid medium into the chamber and perform work relative to that medium in order to accomplish a particular function. For example, in a piston engine, gas and fuel are received in a chamber and ignited where they expand to enlarge the chamber by moving a piston. In an axial flow turbine, expanding gases are introduced into a chamber and exhausted through vanes of a fan where the velocity of the expanding gases is converted into rotary motion to develop the power of a turbine. In the case of a pump/compressor, the fluid is introduced into a chamber and pressurized to move a liquid or compress a gas. A vacuum apparatus works in the opposite manner wherein a gas is drawn into the chamber and the chamber expanded to create a vacuum.

In the past, these processes and apparatus involving an expansible or compressible chamber have suffered from poor efficiency. Certainly a primary reason for this lack of efficiency has been the failure of these processes to fully convert the energy present in the working medium, to power. This is particularly evident in the axial flow gas turbine which uses a fan to extract energy, in the form of pressure and velocity, from a flow of the fluid. On one side of the turbine fan, there is a high velocity and pressure of the fluid while on the opposite side of the fan there is a lower velocity and pressure of fluid. It is the failure of the turbine to fully extract all of the velocity and pressure of the fluid, which results in the relatively poor efficiency of this engine.

The failure to fully exhaust energy in the piston engine develops from the inherent design of the piston chamber which requires that the compression stroke and the expansion stroke have the same volume. Even though there is energy left in the expansion stroke, the piston is limited in its travel and therefore must exhaust the expanding gasses before their energy is fully depleted against the piston. The fact that these piston engines suffer from pre-ignition and pre-detonation is well-known. They also sacrifice considerable efficiency due to the fact that the expansion and exhaust stages occur in sequence. Thus the cycle process is relatively complex.

Piston engines are also well-known to be reciprocating engines in that the pistons are constantly reversing direction. The circular motion present in turbine and rotary engines is inherently balanced and of course easier to couple to an output. While each of these types of engines has certain advantages, there is no engine system in the prior art which combines these advantages of a rotary apparatus, with an ability to use a variety of fuels, minimal moving parts, with inherent valving and timing in a simplified cycle process. More generally, there is no engine, pump, compressor or vacuum apparatus which provides increased efficiency by fully exhausting the energy from a working medium.

SUMMARY OF THE INVENTION

The expansible and compressible chamber associated with the present invention overcomes these deficiencies of the prior art. In addition, it combines many of the advantages associated with the different systems of the past while adding even further advantages to the new system. When the concept is embodied in the form of an engine, a housing is provided with an inner surface which is concentric with a stationary shaft. A rotor having at least one vane is rotatable on the shaft with the vane defining an expansible chamber with the inner surface of the housing. This chamber is further defined by a rotary block which counter rotates with the rotor and includes a recess which is configured to receive the vane of the rotor. In operation, a pressurized gas is introduced through the stationary shaft and through alignable ports in the shaft and the rotor, into the chamber. This creates a pressure against the vane and causes the rotor to rotate within the housing.

When the vane completes a full revolution and the ports are again aligned, additional pressurized gas produces a force on the back side of the vane continuing the rotation. The exhaust gases from the prior revolution are moved by the front side of the vane to an exhaust port. Thus the expansion and exhaust stages occur simultaneously in this engine. Furthermore, the engine can be designed so that the volume of the expansible chamber is sufficiently large to reduce the pressure of the pressurized gases to an ambient pressure prior to exhaust. In such an embodiment, the energy of the gas is fully depleted prior to expulsion from the engine.

Due to the porting of this engine, there are no valving requirements so the timing of the engine is inherent in the design. There are fewer moving parts than in the case of a piston engine and no detonation or preignition problems such as those common in that system. A wide range of fuels can be used in an engine application of this invention, while the circular motion present in this engine provides for a balanced design and easier coupling to an output.

Many of these same advantages are present in different applications of the invention. For example, the invention can also be embodied in the form of a pump, a vacuum, or a compressor. In the case of the pump, fluid introduced into the pump is pressurized and moved to a different location. Embodiment of the concept in the form of a compressor enables a gas to be compressed thereby increasing its pressure. In the case of a vacuum, the concept expands a gas to reduce its pressure and create the resulting vacuum.

This concept accommodates a modular design making it possible to form apparatus having many different sizes and shapes. In some cases, multiple rotors can be combined with a single rotary block to further enhance the modular design. Multiple rotors, stages and sections, can be combined to optimize a particular configuration.

In one aspect of the invention, the apparatus defining an expansible or contractible chamber includes a housing having a first housing portion with a first axis and an inner surface with a first radius, and a second housing portion having a second axis and an inner surface with a second radius. A rotor rotatable within the first housing portion and about the first axis has an outer surface with a third radius less than the first radius. A block rotatable within the second housing portion and about the second axis has an outer surface with a fourth radius. A vane disposed on the rotor defines with the outer surface of the rotor, the inner surface of the first housing portion and the outer surface of the block, a chamber having a volume variable with the angular position of the rotor relative to the housing. Portions of the block define a recess which is sized and configured to receive the vane of the rotor. Means is provided for introducing a fluid into the chamber and for exhausting the fluid from the chamber.

In a further aspect of the invention, a method is disclosed for performing work on a fluid. This method includes the step of providing a housing, a rotor rotatable within the housing, a vane disposed on the rotor, and defining with the housing and the rotor a working chamber. The method also includes the steps of introducing a fluid into the working chamber and rotating the rotor and the associated vane in order to reduce the volume of the working chamber. After performing work on the fluid in the working chamber, the fluid is exhausted from the working chamber. A preferred method further comprises the step of providing a block rotatable within the housing, the block defining a recess sized and configured to receive the vane of the rotor. The block and the rotor are rotated at a common angular velocity.

These and other features and advantages of the invention will be more apparent with a discussion of preferred embodiments of the concept and reference to the associated drawings.

DESCRIPTION OF THE DRAWING

FIG. 6 is a radial cross-section view similar to FIG. 4 illustrating the rotor in an exhaust position;

FIG. 7 is a radial cross-section view similar to FIG. 4 and illustrating a further embodiment of a turbine engine of the invention;

FIG. 17 is a radial cross-section view similar to that illustrated in FIG. 4 of a further embodiment of the invention including two rotors in a single chamber assembly with each rotor revolving about a pressurized intake channel;

FIG. 18 is a radial cross-section view similar to FIG. 17 of a further embodiment of the invention wherein only one of the two rotors revolve about a prerssurized intake channel.

DESCRIPTION OF PREFERRED EMBODIMENTS AND BEST MODE OF THE INVENTION

Figure 1:
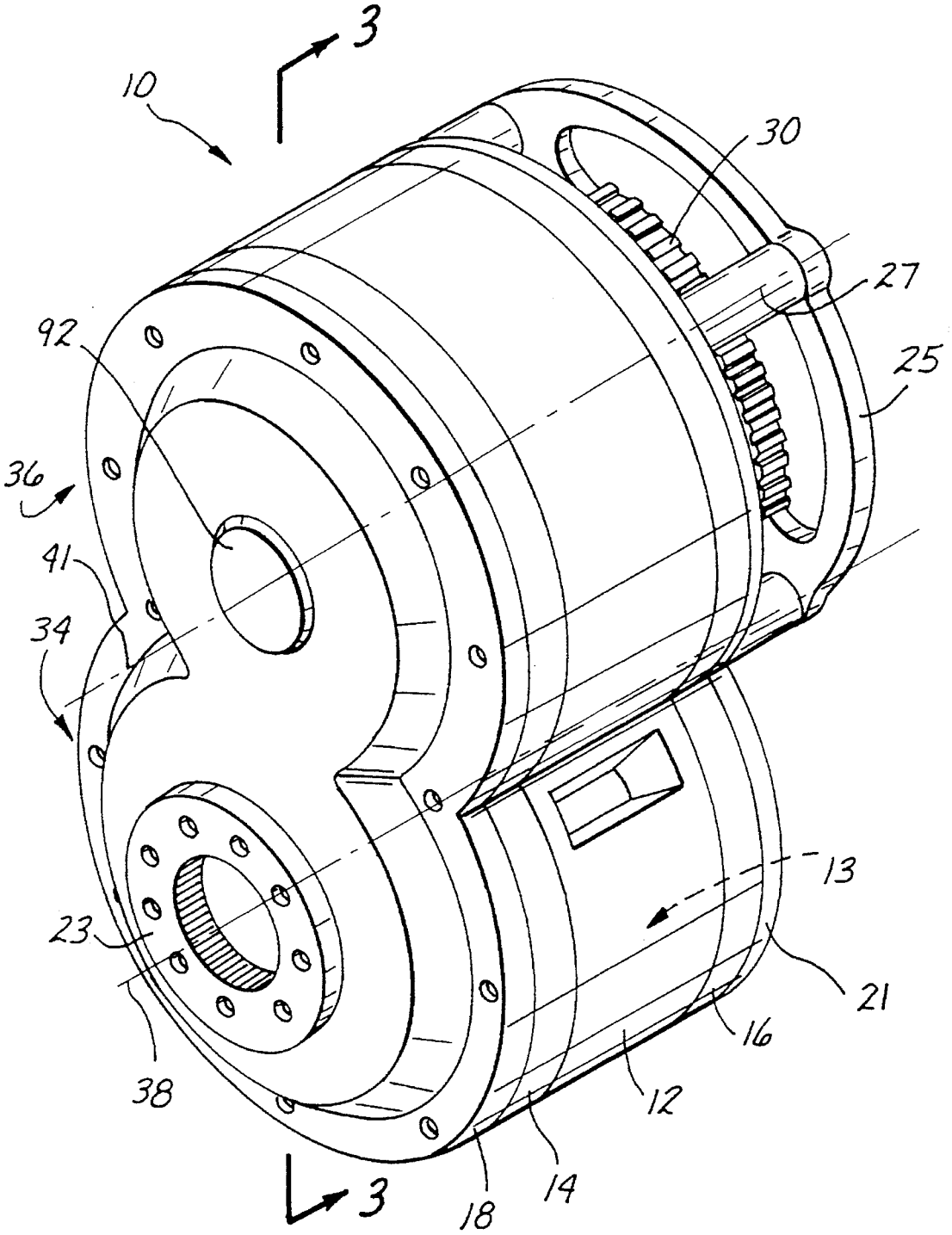
FIG. 1 is a perspective view of one embodiment of the chamber assembly of the present invention.
Figure 2:
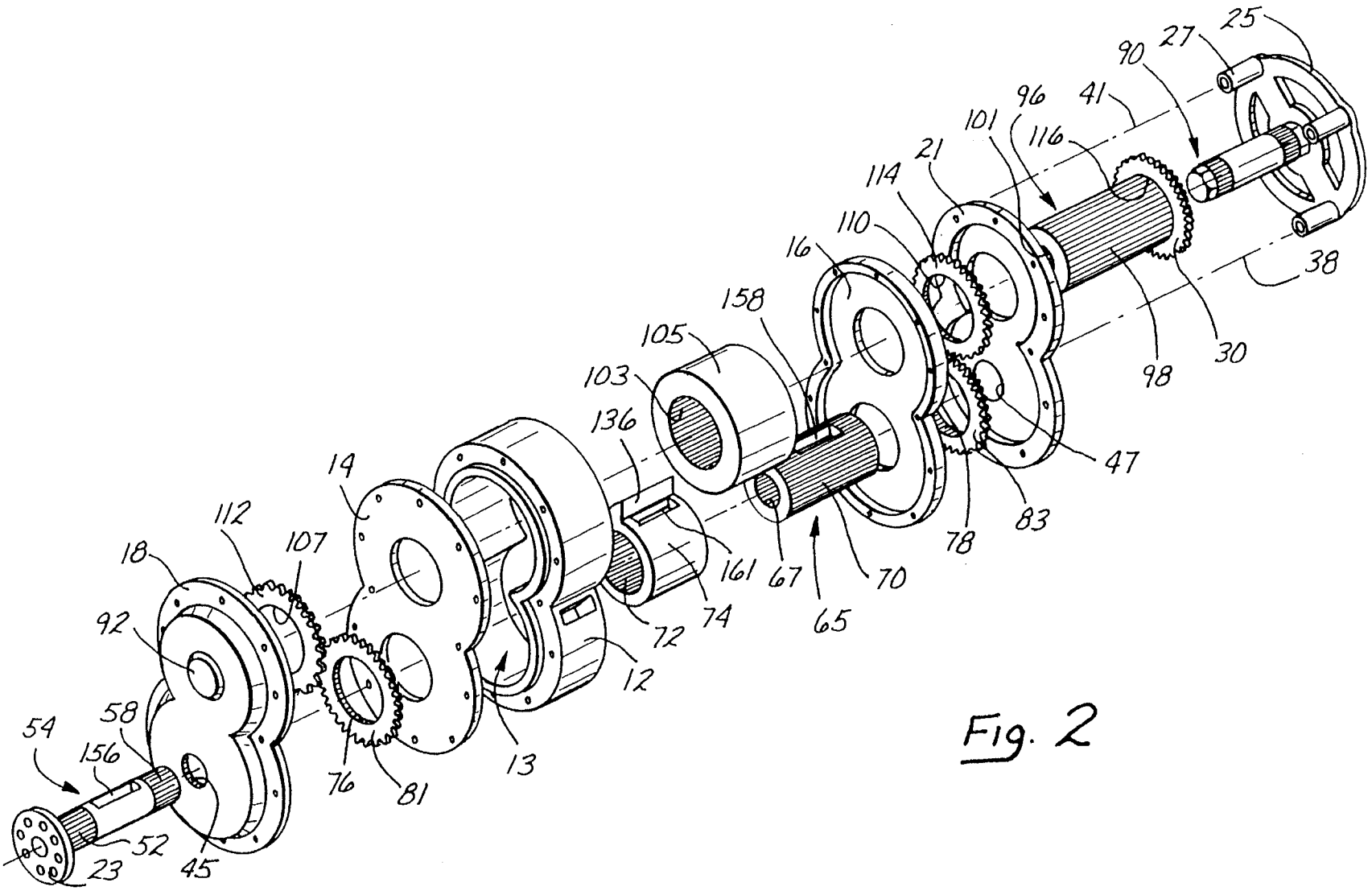
FIG. 2 is an exploded view of the chamber assembly illustrated in FIG. 1.

An expansible compressible chamber is illustrated in FIG. 1 and designated generally by the reference numeral 10. FIG. 1 is an assembled view of the chamber assembly 10 and best illustrates how the components of the assembly are combined in a preferred embodiment. FIG. 2 is an exploded view and provides an illustration of the individual components in this embodiment of the assembly 10.

As illustrated in FIG. 1, the chamber assembly 10 includes a housing 12, an interior chamber 13, a pair of chamber end plates 14 and 16 and a pair of housing end plates 18 and 21. A stationary flange 23 is provided at the end plate 18 while a shaft support 25 is provided at the end plate 21. The shaft support 25 is mounted to the end plate 21 by a plurality of posts 27 and also functions as a housing for an output gear 30.

As illustrated in FIG. 1, the chamber assembly 10 of this embodiment includes two sections a rotor section 34 and block section 36. The section 34 has an axis 38 which extends through the center of the flange 23 while the section 36 has an axis 41 which extends through the center of the output gear 30.

As best illustrated in FIG. 2, the housing end plates 18 and 21 are provided with splined apertures 45, 47 which are sized and configured to receive a shaft 54 that carries the flange 23. This shaft 54 is also provided with splines 56 and 58 which mesh with the splines in the apertures 45, 47 respectively in the housing endplates 18 and 21. A rotary shaft 65 is provided with internal splines 67 and external splines 70.

The splines 70 on the outer surface of the rotating shaft 65 register with complimentary splines 72 on the interior surface of a rotor 74 which is described in greater detail below. These external splines 70 also register with splined apertures 76 and 78 in timing gears 81 and 83 respectively. The timing gear 81 rotates with the shaft 65 between the chamber endplate 14 and the housing endplate 18. Similarly, the timing gear 83 rotates with the shaft 65 between the chamber endplate 16 and the housing endplate 21.

Figure 3:
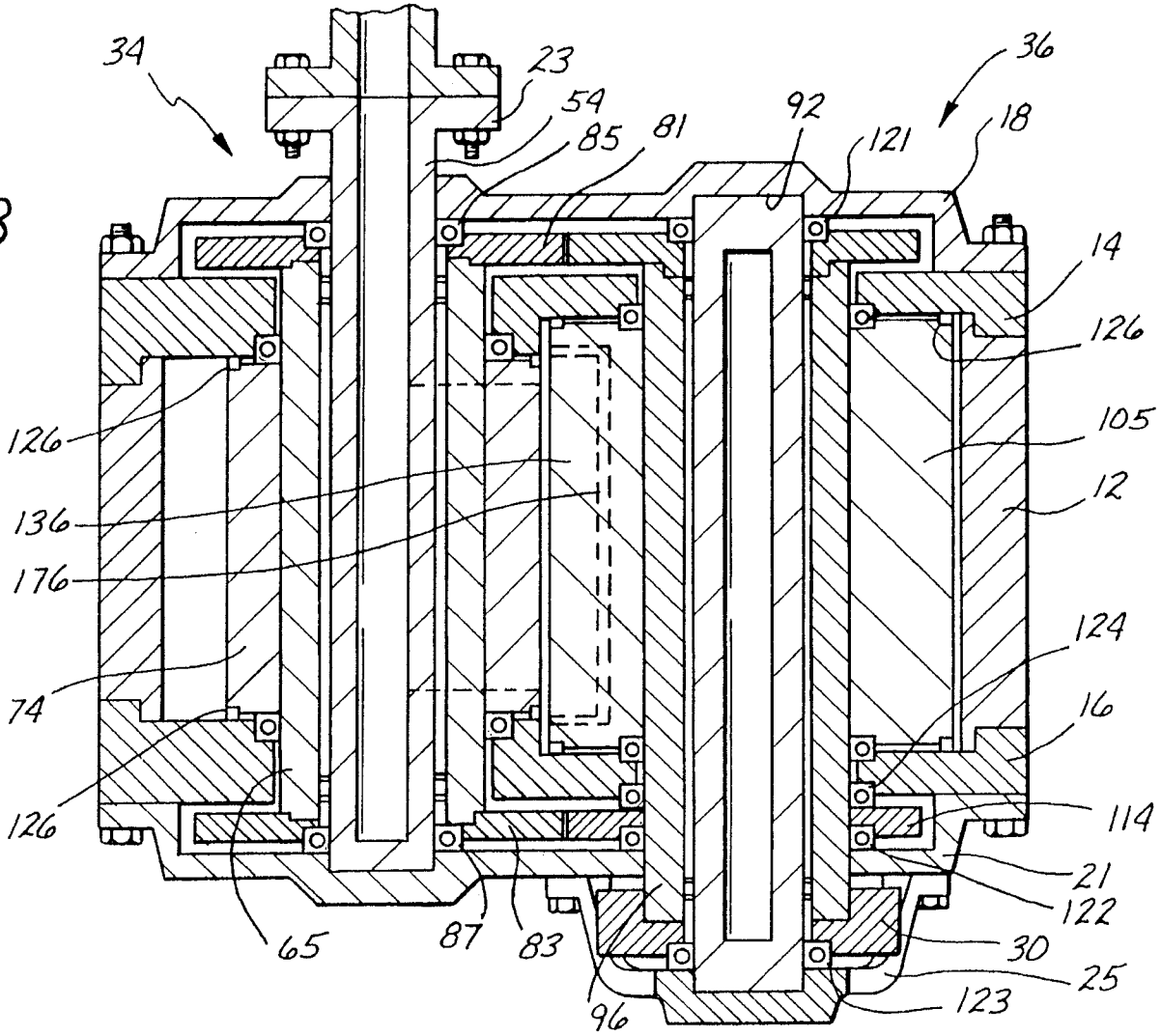
FIG. 3 is an axial cross-section view taken along lines 3—3 of FIG. 1.

The shaft 65 together with the timing gears 81 and 83 are supported in a preferred embodiment by a pair of bearings 85 and 87, best shown in FIG. 3. In this particular embodiment, the bearings 85, 87 function as both radial and thrust bearings. The bearings 85 and 87 support the shaft 65 in a rotating relationship with the stationary shaft 54. In an axial direction, the bearings 85 and 87 support the rotating shaft 65 and associated timing gears 81 and 83 against the stationary housing endplates 18 and 21. These rotating elements, including the shaft 65, rotor 75, and timing gears 81, 83 are disposed in a concentric relationship with the axis 38 of the rotor section 34.

A structure complimentary to that previously discussed is disposed along the axis 41 in the block section 36. This structure includes a stationary shaft 90 which is fixed at one end to the shaft support 25 and supported at the other end by a recess 92 in the housing endplate 18. A rotating shaft 96 similar to the shaft 65 is provided with exterior splines 98 and interior splines 101. The exterior splines 98 register with interior splines 103 of a rotating block 105 and also with splined apertures 107 and 110 in timing gears 112 and 114, respectively. A splined aperture 116 in the output gear 30 is also sized to receive the splines 98 on the shaft 96.

The rotating elements including the shaft 98, rotor 105, timing gears 112, 114, and output gear 30 are supported in a preferred embodiment by bearings 121 and 123 best shown in FIG. 3. These bearings 121, 123 function as both radial and thrust bearings providing the necessary support between the rotating elements and the supporting stationary elements. For example, the bearing 123 is disposed between the rotating output gear 30 and the shaft support 25. The rotating timing gear 114 is supported against the stationary housing endplate 21 by a bearing 122 and against the stationary chamber endplate 16 by a bearing 124. The bearings 85, 87, 121 and 123 are preferably ball bearings including outer and inner races held in rotating relationship by the exterior splines of the shafts 54, 90 and the interior splines of the shafts 65, 96.

Appropriate seals, such as those designated by the reference numeral 126, can also be used to provide for sealing engagement between the rotating and stationary elements of the assembly. Many other seal designs will be appropriate to this assembly 10 depending on assembly configurations and assembly groupings.

Of particular interest to the present invention is the configuration of the housing 12 and the inter-relationship between the rotor 74 and block 105 within the housing 12. Interiorly, the housing 12 has two cylindrical surfaces 125 best illustrated in FIG. 4. These surfaces 125, 127 each have a radius. The combined length of these two radii exceed the distance between the axis 38 and the axis 41 so that the two surfaces 125 and 127 tend to form the figure "8". The surface 125 is concentric with the axis 38 while the surface 127 is concentric with the axis 41. Importantly, these surfaces 125, 127 form an opening 130 between the section 34 and the section 36.

The rotor 74 has an outer surface 134 and a vane 136 which extends from the surface 134 outwardly into proximity with the surface 125. A chamber 141 is formed between the stationary surface 125 of the housing 12 and the rotating surface 134 of the rotor 74. Axially, the chamber 141 extends between the chamber endplates 14 and 16. With the chamber 141 thus configured, the vane 136 preferably has an axial dimension which is substantially equivalent to the axial dimension of the chamber 141 and a radial dimension which is substantially equivalent to the radial dimension of the chamber 141. Thus the rotating vane 136 divides the chamber 141 into a leading portion 143 which is in front of the rotating vane 136, and a trailing portion 145 which is behind the rotating vane 136.

In the block section 36, the rotating block 105 is provided with an outer surface 152 which is concentric with and disposed in close proximity to the inner surface 127 of the housing 12. Importantly, this surface 152 of the block 105 has a radius which, when added to the radius of the surface 134 of the rotor 74, is approximately equal to the distance separating the axis 38 and 41. With these dimensions and orientation of the block 105 and rotor 74, the respective surfaces 134 and 152 are brought into close proximity through the opening 130 of the housing 12.

In operation, the rotor 74 and block 105 rotate in opposite directions. For example, the block 105 might rotate in the direction of an arrow 153 while the rotor 74 rotate in the opposite direction as illustrated by an arrow 155. Since the surfaces 134 and 152 extend in close proximity, the extra radius required by the vane 36 must be accommodated in an axial recess 154 formed in the outer surface 152 of the block 105. In order that the rotating vane 136 is always aligned with the rotating recess 154, it is important that the surfaces 134 and 152 rotate with a constant linear velocity. In an embodiment wherein the surfaces 134, 152 have the same radius, the rotor 74 and rotating block 105 would have the same angular velocity. It is the purpose of the timing gears 81, 83, 112 and 114 to establish this preferred rotating relationship between the rotor 74 and block 105.

The introduction and exhaust of a fluid medium into and out of the chamber 141, will depend on the intended use of the assembly 10. In the embodiment illustrated in FIGS. 2–4, the assembly 10 is adapted to function as a turbine engine. In this embodiment, a fluid medium is introduced into the chamber 141 through the shaft 54. This introduction occurs through a stationary port 156 in the shaft 54, and rotating ports 158 and 161 in the respective shaft 65 and rotor 74. As the rotating ports 158 and 161 align with the stationary port 156, the fluid medium under pressure within the shaft 54 passes into the trailing portion 145 of the chamber 141. An exhaust port 163 is also provided in the illustrated embodiment. This port 163 extends from the chamber 141 through the wall of the housing 12.

Figure 4:
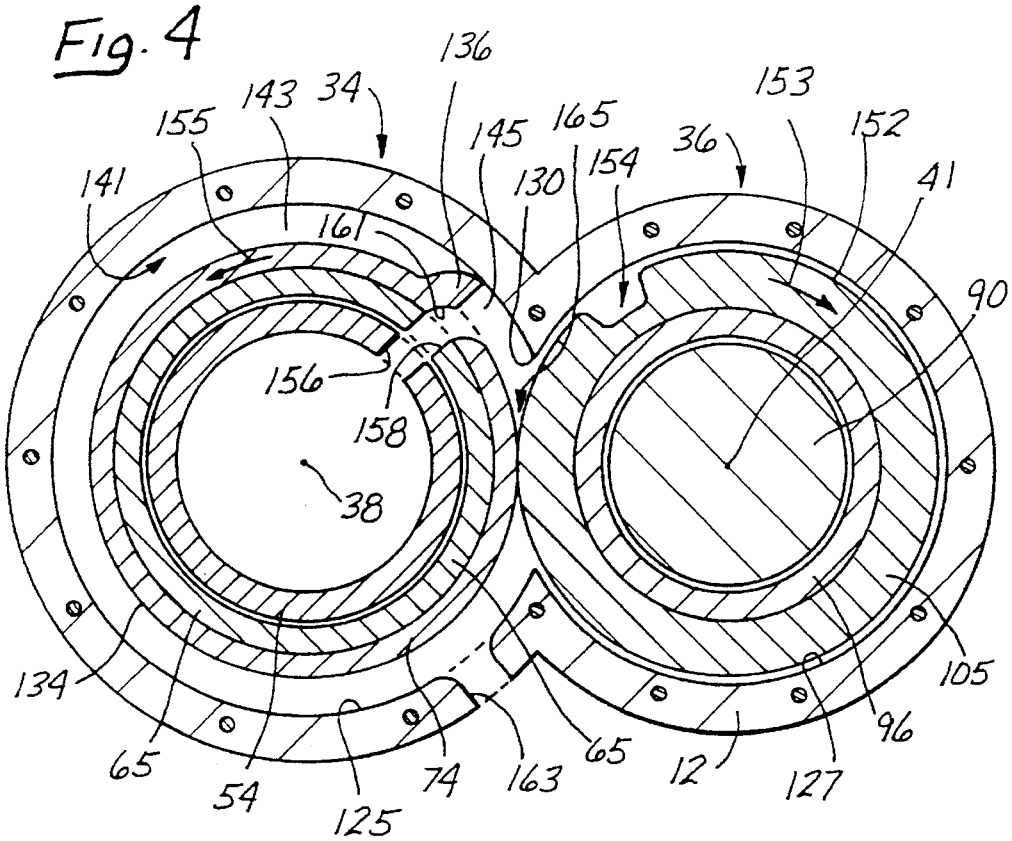
FIG. 4 is a radial cross-section view taken along lines 4—4 of FIG. 3 and illustrating a rotor of a turbine engine disposed in an intake position.

Operation of the expansible, contractible chamber assembly 10 will depend on the function which the chamber is adapted to perform. While this adaptation will vary for a pump, compressor, or vacuum, the function can best be understood with reference to FIGS. 4, 5 and 6 which illustrate a preferred embodiment of a turbine. In this embodiment, the shaft 54 is hollow and therefore provides a conduit for initially receiving a pressurized fluid such as steam. As this fluid is introduced along the axis 38 it moves under pressure through the port 156 in the shaft 54, the port 158 in the rotary shaft 65, and the port 161 in the rotor 74. This can occur only when the ports 156–161 are aligned as illustrated in FIG. 4.

When this alignment occurs the fluid is directed into the chamber 141, and more specifically into the trailing portion 145 of that chamber. The assembly 10 is designed in this embodiment to provide for that alignment when the vane 136 is just past the opening 130 of the housing 12. At this point in time, the trailing portion 145 of the chamber 141 is relatively small compared to the leading portion 143.

Figure 5:
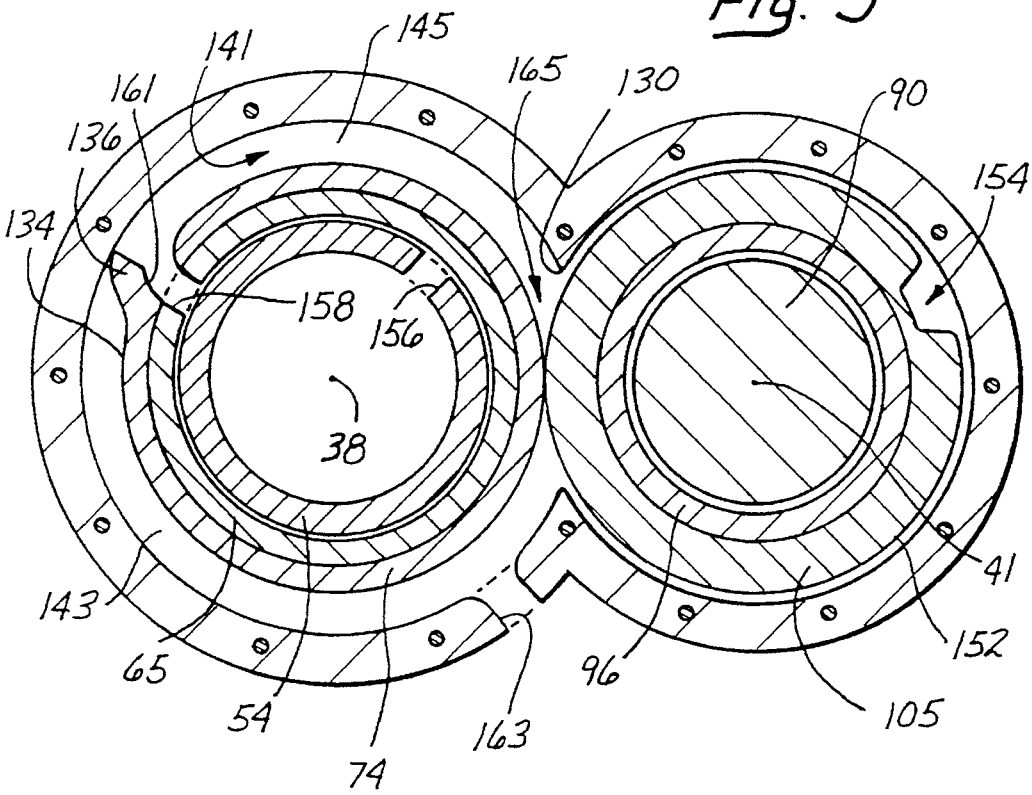
FIG. 5 is a radial cross-section view similar to that illustrated in FIG. 4 wherein a rotor is disposed in an intermediate position.

With the leading portion 143 maintained at a lower ambient pressure by the exhaust port 163, the higher pressure of the steam in the trailing portion 145 tends to move the vane 136 counter-clockwise in the direction of the arrow 155. Movement of the vane 136 is of course accompanied with a corresponding rotation of the rotor 74 and the rotary shaft 65 in the counter-clockwise direction. As these elements rotate, their associated ports 161 and 158, respectively, move out of alignment with the port 156 in the stationary shaft 154. This closes the fluid passage between the input channel within the shaft 54 and the chamber 141 as illustrated in FIG. 5. Even without the introduction of further pressurized fluid into the chamber 141, the initial pressurized charge in the trailing portion 145 will continue to exert a force on the vane 136 as the steam expands within the chamber 141. As the vane 136 rotates counter-clockwise within the chamber 141, the trailing portion 145 increases in volume with a corresponding decrease in the pressure of the fluid in the trailing portion 145.

In a preferred embodiment, the size of the chamber 141 is chosen so that the pressure of the fluid in the trailing portion 145 achieves ambient pressure at about the time the vane 136 clears the exhaust hole 163 as illustrated in FIG. 6. This enables the chamber assembly 10 to fully deplete the energy in the fluid before it is exhausted to the environment.

While the work of the assembly 10 is being performed primarily in the rotor section 134 of the assembly, operation of the rotary block 105 in the block section 36 is also of particular importance. This block 105 rotates in a direction opposite to that of the rotor 74, clockwise in FIG. 4. Rotation of the block 105 is maintained at a constant ratio with respect to the rotation of the block 74 so that the associated surfaces 152 and 134, respectively, move at a substantially constant linear velocity at their closest point of approach. In a preferred embodiment, this point is actually a line 165 which extends parallel to the axes 38, 41, and which appears as a point in the radial views of FIG. 4–6, designated generally by the reference numeral 165.

This ratio of angular rotation is maintained constant by the interlocking gear pairs 83, 110, and 81, 112, best illustrated in FIG. 2. As the rotor 74 moves in the counter-clockwise direction it is the purpose of the block 105 to close the trailing portion 145 of the chamber 141 in the clockwise direction. Thus the block 105 seals the trailing portion of the chamber 145 in the rearward direction so that the trailing portion 145 has a volume which increases only with rotation of the rotor 74 and the associated vane 136.

In a preferred embodiment, the ports 156–161 are not aligned until the counter-rotating recess 154 in the block 105 is beyond the opening 130. This insures that the pressurized fluid enters the portion 145 of the chamber 141 at a time when the outer surface 152 is the only surface of the block 105 which defines the chamber 141. Only after the vane 136 has cleared the exhaust port 163 does the recess 154 of the block move into proximity with the opening 130 as illustrated in FIG. 6. Then as the radius of the rotor 74 is increased at the vane 136, the radius of the block 105 is correspondingly decreased at the recess 154. The clearance provided by the recess 154 enables the vane 136 to pass through the point of closest proximity 165, to the initial position illustrated in FIG. 4.

At this position the ports 156–161 are again aligned and pressurized fluid from the stationary shaft 154 is again introduced into the trailing portion 145 of the chamber 141. In response to this pressure, the vane 136 is again forced into counter-clockwise rotation as previously discussed. Any exhaust remaining in the leading portion 143 of the chamber 141 is forced through the exhaust port 163 by the rotating vane 136. Thus, in a given cycle the vane 136 functions not only to exhaust the leading portion 143 of the chamber 141 but also to expand the trailing portion 145 of the chamber 141.

Additional power and torque can be achieved by providing additional ports in the stationary shaft 54. Thus the embodiment illustrated in FIG. 7 includes not only the port 156, but also two additional ports 166 and 168. These three ports individually and sequentially align with the ports 158 and 161 in the rotary shaft 65 and rotor 74 respectively. For example, as the rotating ports 158 and 161 align with the port 166, additional pressurized fluid is introduced into the trailing section 145 of the chamber 141. This chamber portion 145 is further pressurized when the ports 158, 161 align with the port 168. Any number of these ports can be provided in the stationary shaft 54 to feed additional pressurized fluid into the trailing portion 145 of the chamber 141. These ports 156, 166 and 168 are sequentially opened and closed as the rotor 74 rotates relative to the shaft 54.

While these basic functions of the assembly 10 will be included in most embodiments of the invention, slight variations may offer particular advantages under some circumstances. For example, the embodiment of FIG. 7 includes a shaft 54 which is not hollow. In this embodiment, the shaft 54 does not provide a channel for the introduction of pressurized fluid. Rather, this channel is provided by an input port 167 in the housing 12. This port forms a controlled passage which extends between the chamber 141 and regions exterior to the housing 12. In this embodiment, the pressurized fluid is introduced through the port 167 and into the trailing portion 145 of the chamber 141. Within the trailing portion 145 of the chamber 141, the pressurized fluid functions in the manner previously discussed.

Figure 8:
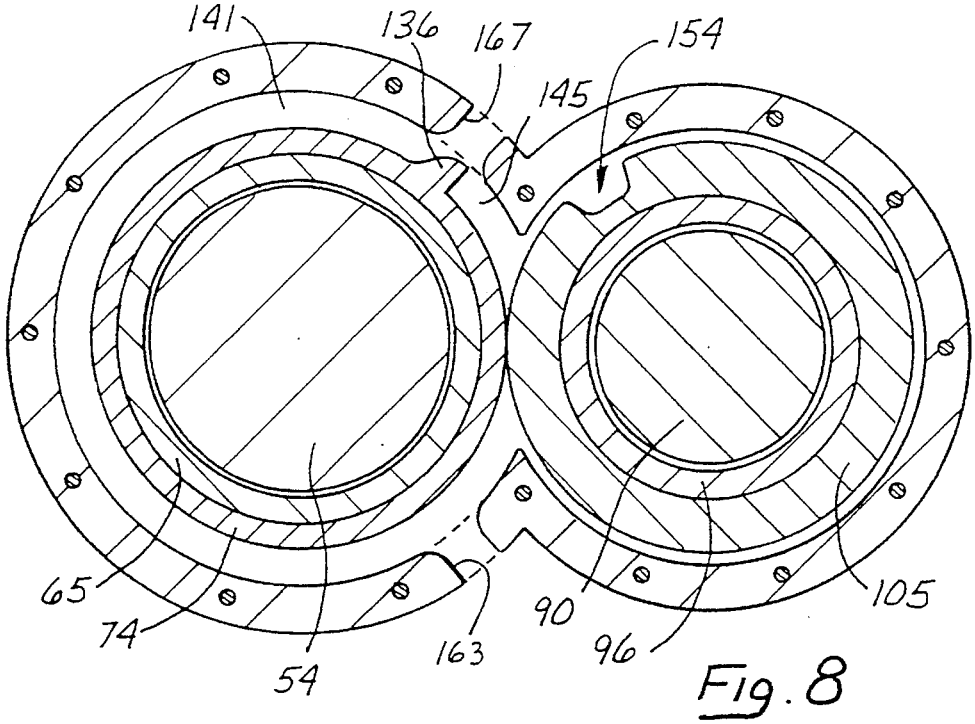
FIG. 8 is a radial cross-section view similar to FIG. 4 of a further embodiment of the invention.

It will be noted that in this FIG. 8 embodiment, the port 167 remains open so that the pressurized fluid continues to feed into the trailing portion 145 of the chamber 141. In such an embodiment, the high pressure is maintained against the trailing surface of the vane 136 during a substantial portion of the cycle. External valving and injection through the port 163 could of course be provided in which case this embodiment would function similar to that discussed with reference to FIG. 4.

Figure 9:
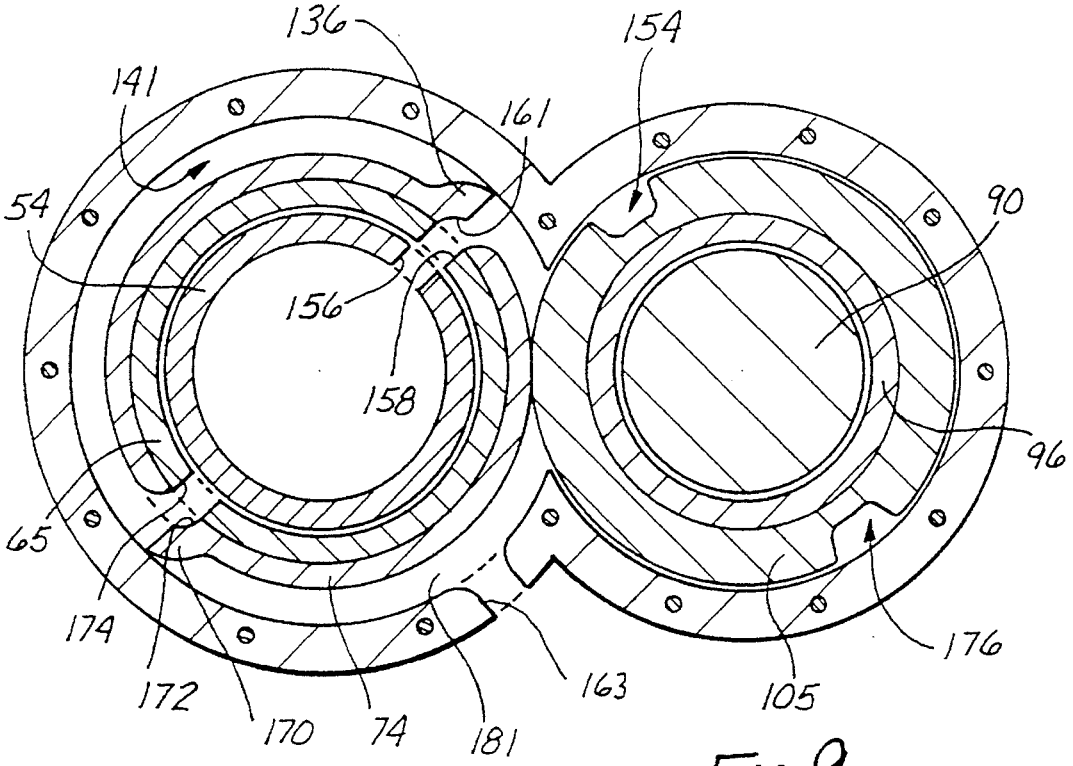
FIG. 9 is a radial cross-section view similar to FIG. 4 of still a further embodiment of the invention.

The embodiment illustrated in FIG. 9 is also similar to that discussed with reference to FIG. 4. However, this embodiment includes two vanes, the vane 136 previously discussed and a second vane 170. This embodiment is representative of all embodiments having more than one vane 136. The vanes in these embodiments will preferably be equally spaced around the 360° of the rotor 74. Thus in the illustrated embodiment, the vanes 136, 170 are separated by 180°. The vane 170 is associated with a port 172 in the rotor 74 and a port 174 in the rotary shaft 65.

While the recess 154 in the block 105 is provided to accommodate the vane 136, a similar recess 176 is provided in the block 105 to accommodate the vane 170. The recesses 136 and 176 are also separated by 180°. Alternatively, the block 105 could be formed with an outer surface 152 having a circumference which is one-half that of the outer surface 134 of the rotor 74. In such a case, the block would rotate at twice the angular velocity of the rotor 74 and the single recess 154 would accommodate both of the vanes 136 and 170.

Operation of this embodiment is similar to that previously discussed except that the chamber 141 is divided into two 180° portions each associated with one of the vanes 136, 170. Thus the chamber 141 is associated with the vane 136 while the chamber 181 is associated with the vane 170. While the trailing portion 145 of the chamber 141 expands in the manner previously discussed, the leading portion 143 of the chamber 141 initially has a constant volume. This constant volume is defined by the 180° separation between the vanes 136 and 170 after the vane 170 passes the exit port 163 however, the leading portion 143 of the chamber 141 begins to decrease in the manner previously discussed.

The advantage of this embodiment is that fresh pressurized fluid is injected into the chamber twice for each revolution. This of course provides an increase in torque as well as power. In the embodiment of FIG. 7, this increased torque and power is provided using multiple ports in the stationary shaft 54 in the manner previously discussed.

Figure 9A:
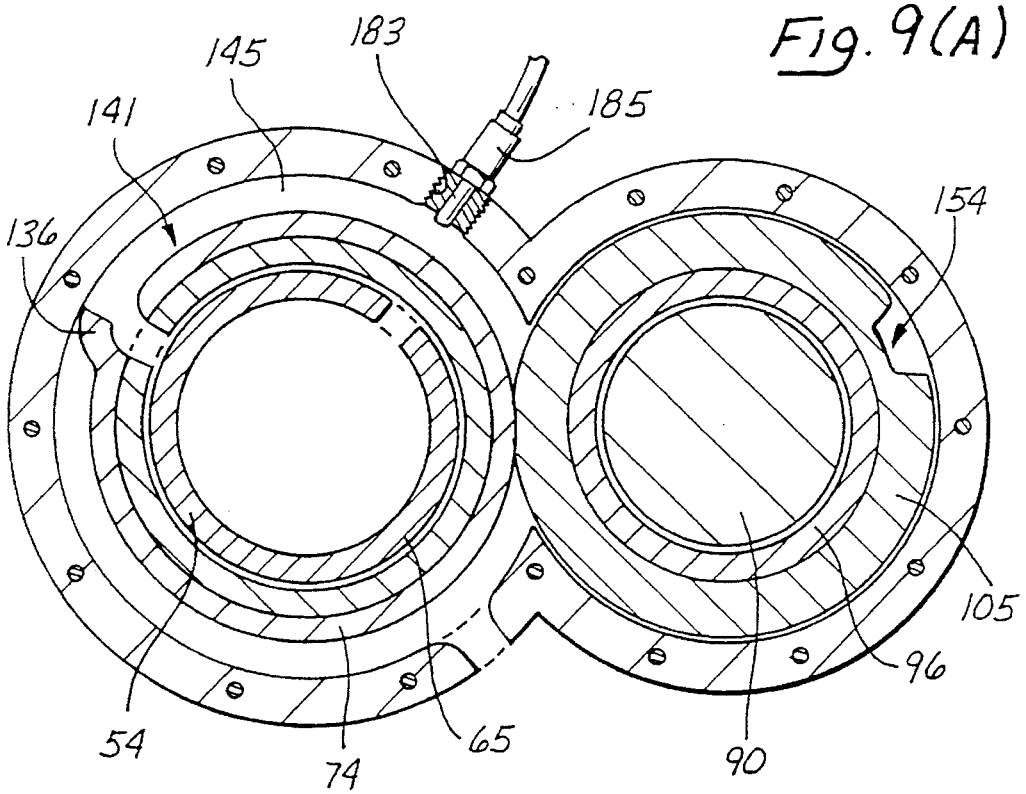
FIG. 9*a* is a radial cross-section view similar to FIG. 4 illustrating an embodiment which functions as an internal combustion engine.

A further embodiment of the chamber assembly 10 illustrated in FIG. 9*a* is similar to that of FIG. 4 where the axial channel within the stationary shaft 54 is used to convey a combustible fuel into the trailing portion 145 of the chamber 141. Such an embodiment would preferably include a hole 183 through the wall of the housing 12 at the same location as the port 167 illustrated in FIG. 8. A spark plug 185 could be positioned within this hole to ignite the combustible fuel within the chamber 141. The resulting combustion would expand the gases in the chamber forcing the rotor 74 into the desired rotation. In this manner, the chamber assembly 10 can be adapted to function as an internal combustion engine.

In a similar embodiment, the plug 185 in the hole 183 could be replaced with a diesel injector. In such an embodiment, the heat of compression would be inherent in the air introduced from the channel of the stationary shaft 54 into the trailing portion 145 of the chamber 141. With the timed injection of fuel, combustion typical of a diesel engine would produce the expanded gases needed to imparting movement to the rotor 74.

Figure 10:
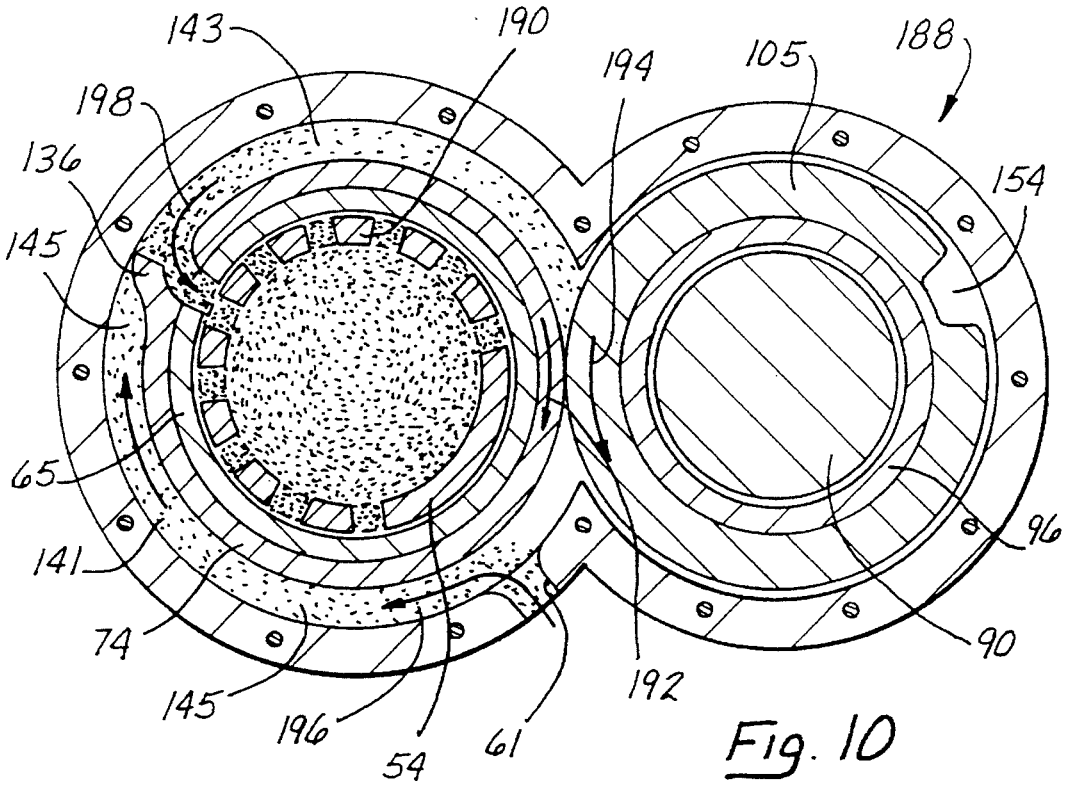
FIG. 10 is a radial cross-section view similar to FIG. 4 of a pump/compressor embodiment of the invention.
Figure 11:
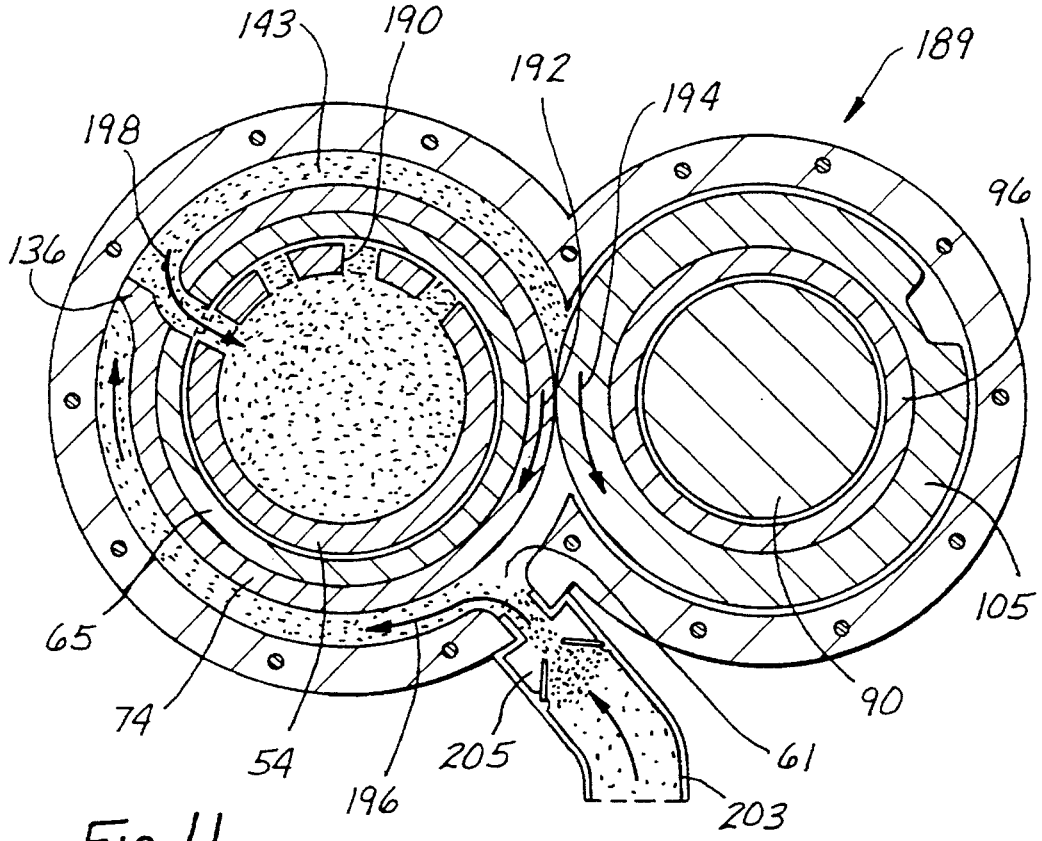
FIG. 11 is a radial cross-section view similar to FIG. 4 of a vacuum embodiment of the present invention.

In the foregoing discussion, the chamber assembly 10 has been discussed with reference to an embodiment specifically adapted for use as an engine or turbine. It will now be apparent that the chamber assembly 10 can be otherwise embodied to function as a pump/compressor as illustrated in FIG. 10 or a vacuum pump as illustrated in FIG. 11.

A pump/compressor 188 of the FIG. 10 embodiment again illustrates a multiplicity of ports 190 in the stationary shaft 54. These ports 190 are disposed in equally spaced relationship around a large portion of the circumference of the shaft 54. The pump/compressor 188 functions in a manner similar to that previously discussed, with a few exceptions. The moving components of the pump/compressor rotate in the opposite direction. Thus the rotor 74, vane 136 and associated ports 158 and 161 rotate in a clockwise direction as illustrated by an arrow 192. The rotary block 105 and associated recess 154 rotate in a counter-clockwise direction as illustrated by an arrow 194.

The chamber 194 is also divided by the vane 136 but with the opposite rotation, the leading portion 143 of the chamber includes the ports 158 and 161 in the rotor 74 and rotating shaft 65, respectively. Similarly, the trailing portion 145 of the chamber 141 includes the port 61. In this pump/compressor 188, the port 161 functions as an intake in the trailing portion 145 of the chamber 141.

As the vane 136 rotates in the clockwise direction, the trailing portion 145 of the chamber 141 expands drawing a low pressure fluid through the intake port 61. After the vane 136 clears the line of proximity 165, this fluid in the chamber 141 is in the leading portion 143 of the chamber 141. Since this leading portion 143 is reduced in volume, the fluid in the leading portion 143 is forced under pressure into the ports 161, 158 and 190 into the central area of the shaft 54.

If the fluid entering the port 61 is a liquid, it will be non-compressible, in which case the chamber 10 functions as a pump. The liquid is not compressed but rather moved under pressure from the leading portion 143 of the chamber 141 into and along the stationary shaft 54. With a non-compressible liquid, it is important that the ports 190 be sufficiently large relative to the ports 158, 161 that the leading portions 143 of the chamber 141 is always in communication with the interior region of the shaft 54.

If the fluid passing through the intake port 61 is a compressible gas, it is drawn through the port 61 as illustrated in an intake arrow 196 and pressurized in the reducing volume of the leading portion 143 of the chamber 141. This pressurized gas is then output through the ports 161, 158 and 190 into the interior regions of the stationary shaft 54, as illustrated by the exhaust arrow 198. With the assembly 10 functioning as a compressor, the pressure of the gas within the shaft 54 is relatively higher than the pressure of the gas entering through the intake port 61.

A further adaptation makes it possible for the chamber assembly 10 to function as a vacuum pump 201, such as that illustrated in FIG. 11. The prior discussion relating to the compressor 188 is most relevant to this embodiment of the vacuum pump 201. In this case, the inlet port 61 is coupled to a restricted container 203 so that the gas in the container is drawn through the inlet port 61 in the direction of the intake arrow 196. As this gas is repeatedly withdrawn from the container 203 and introduced into the interior regions of the shaft 204, the pressure within the container 203 becomes greatly reduced. A valve 205 can be provided at the intake port 61 in order to maintain this reduced pressure or vacuum within the container 203.

In the foregoing discussion, the chamber assembly 10 has been illustrated and discussed as a single unit in one of the simplest forms of the invention. It will now be apparent that these single units can be combined, often with shared components, in order to increase the amount of work performed. This increase may be represented as increased torque or power in the case of a turbine, higher flow velocity in the case of a pump, and elevation pressure differentials in the case of a compressor or vacuum pump.

Figure 12:
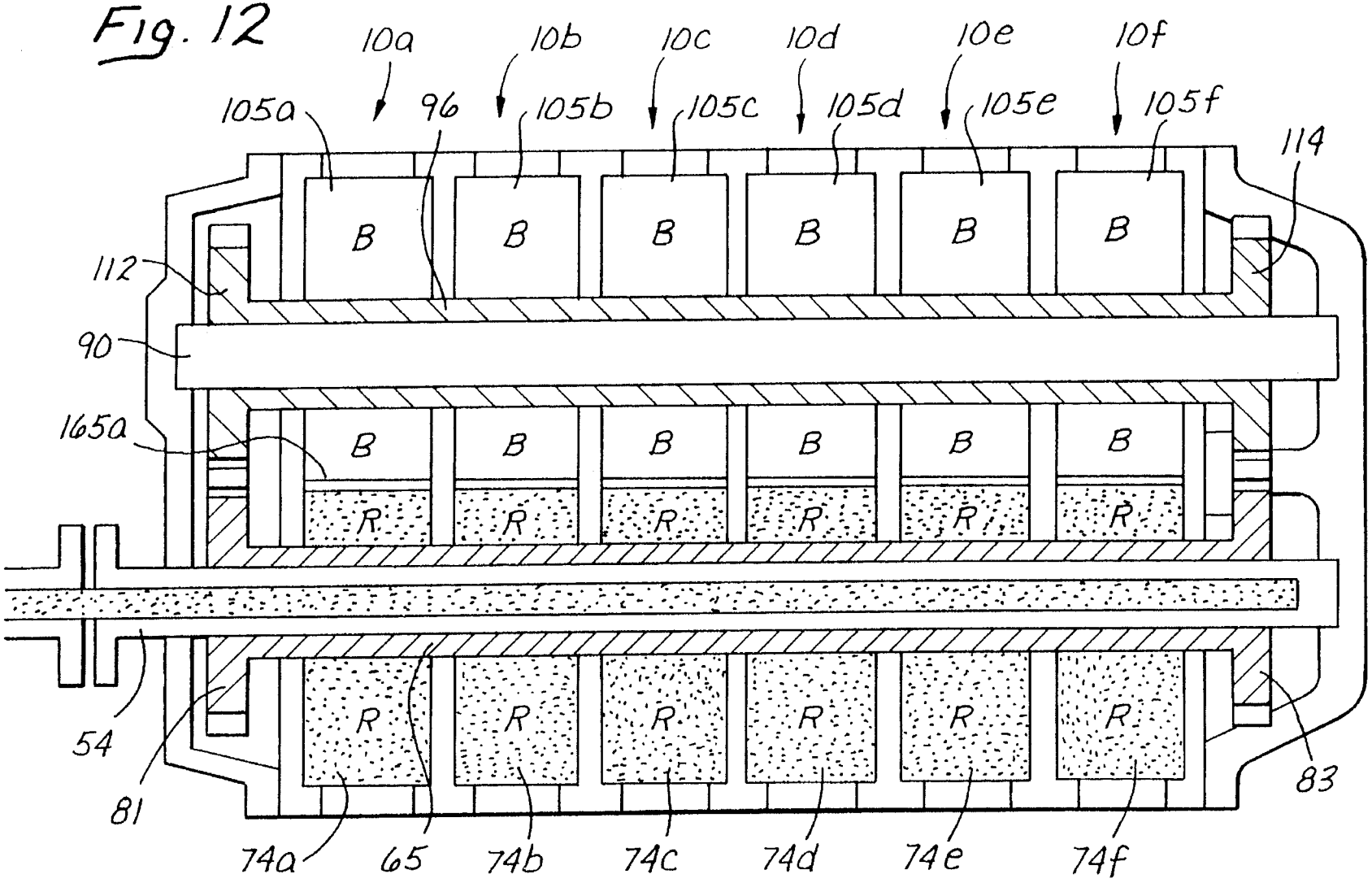
FIG. 12 is an axial cross-section view illustrating multiple assemblies of the invention combined in a bank.

One such combination of chamber assembly units is illustrated in FIG. 12 wherein six units 10*a*–10*f* are disposed along common stationary shafts 54 and 90. In this illustration, components which are similar to those previously discussed are designated by the same reference numerals followed by a lower case letter a–f for each of the respective assemblies 10*a*–10*f*.

This combination of units forms a bank 205 which shares the common stationary shaft 90 for the rotating blocks 105*a*–105*f* and the common stationary shaft 54 for the rotors 74*a*–74*f*. The associated gear pairs 81, 112 and 83,114 at either end of the bank 205 provide the desired surface velocity along the lines of proximity, such as the line 165*a*. The shaft 90 can be either solid or hollow as previously disclosed. The shaft 54 would require the hollow configuration for those embodiments of the units 10*a*–10*f* which need an interior channel for either intake or exhaust.

Figure 13:
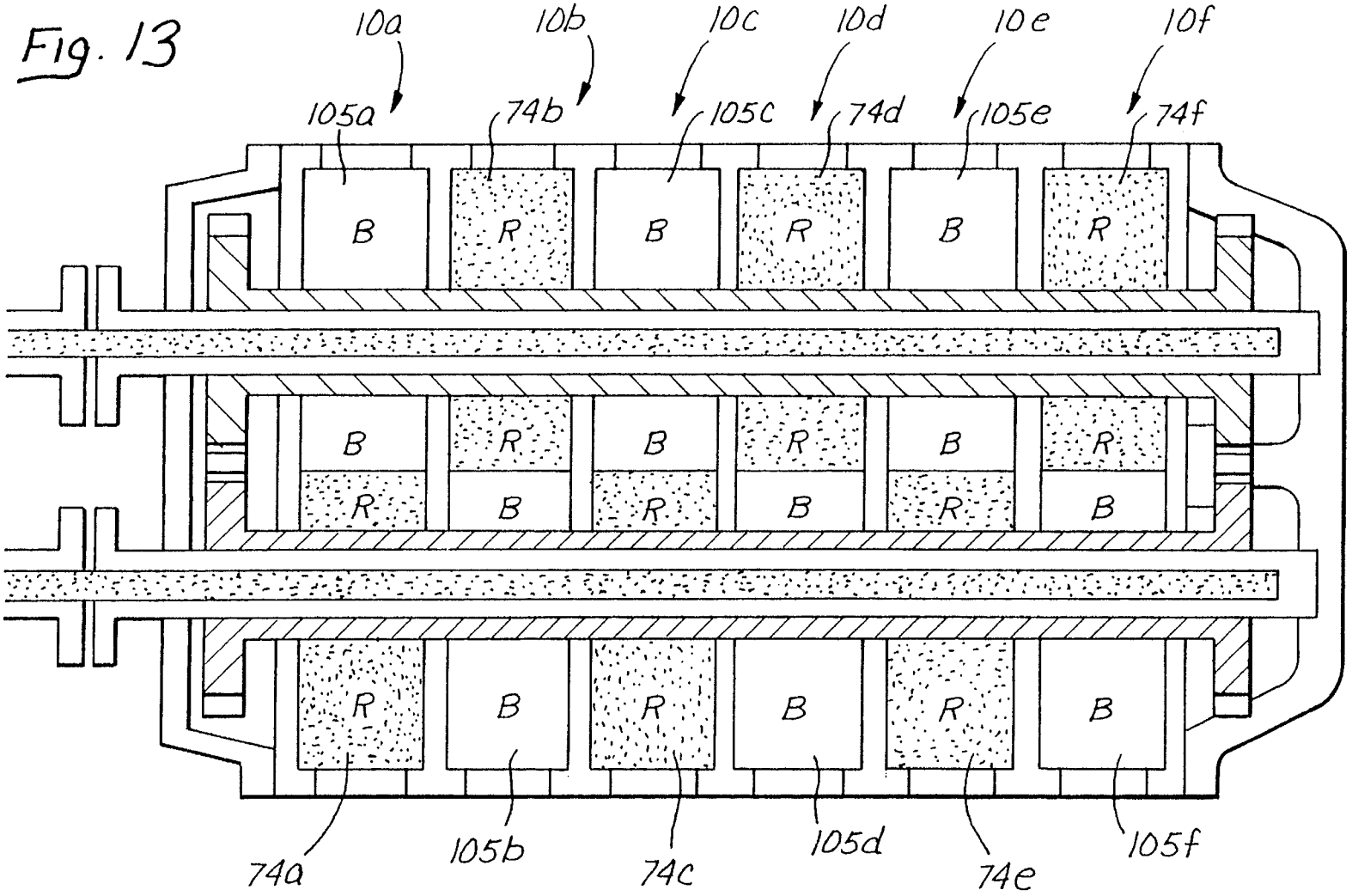
FIG. 13 is an axial cross-section view similar to FIG. 4 with the assemblies alternating in orientation within the bank.

This embodiment of FIG. 12 might be compared with that illustrated in FIG. 13 wherein the rotors and blocks are reversed in alternate assemblies 10*a*–10*f*. Thus the rotors 105*a*, 105*c*, and 105*e* are alternately mounted on a common rotary shaft 96 with the rotors 74*b*, 74*d* and 74*f*. Similarly the rotors 94*a*, 94*c* and 94*e* are alternately mounted on the common rotary shaft 65 with the rotating blocks 105*b*, 105*d* and 105*f*. In this embodiment, each of the shafts 65 and 96 must be ported in proximity to the associated rotors 74*a*–74*f*. It is also necessary that both of the stationary shafts 54 and 90 have a hollow configuration in order to accommodate the intake or exhaust associated with the respective rotors 74*a*–74*f*.

In the illustrated embodiment, an equal number of the rotors 74*a*–74*f* are disposed on each of the rotary shafts 65 and 96 and alternated with the blocks 105*a*–105*f*. It will be apparent that it is not necessary to form the bank 205 in this manner. Rather, different numbers of the rotors 74 could be mounted on the respective shafts 65 and 96, and these rotors could be disposed in adjacent relationship rather than alternated.

Figure 14:
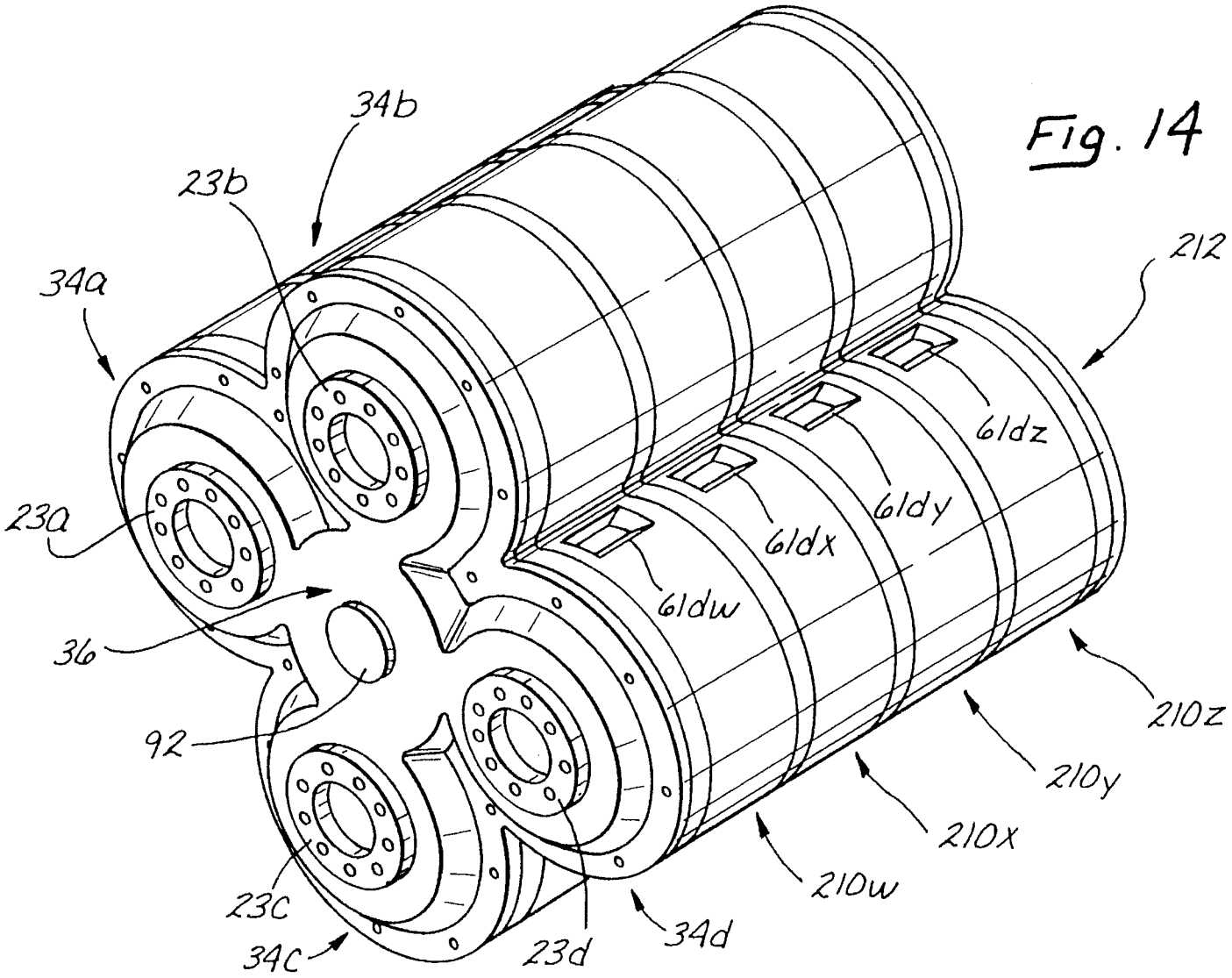
FIG. 14 is a perspective view of a further embodiment of the invention.

A further embodiment of the invention is illustrated in FIG. 14 wherein multiple rotor sections 34*a*–34*d* operate with respect to a single block section 36, in a single section 210 of a bank 212. Four of these sections 210 are illustrated and designated by the reference numerals 210*w*–210*z*. The port, designated by the reference numeral 61*d*, 61 is illustrated for the respective rotor section 34*d* and bank section 210*w*. It will be understood that in this embodiment, there must be a port 61 in each of the assembly sections 34*a*–34*d* for each of the bank sections 210*w*–210*z*.

An associated support flange 23*a*–23*d* can be provided for each of the working sections 34*a*–34*d* at one end of the bank 212. The opposite end of the bank 212 would provide appropriate power take offs such as the output gear 30 discussed with reference to FIG. 2.

Figure 15:
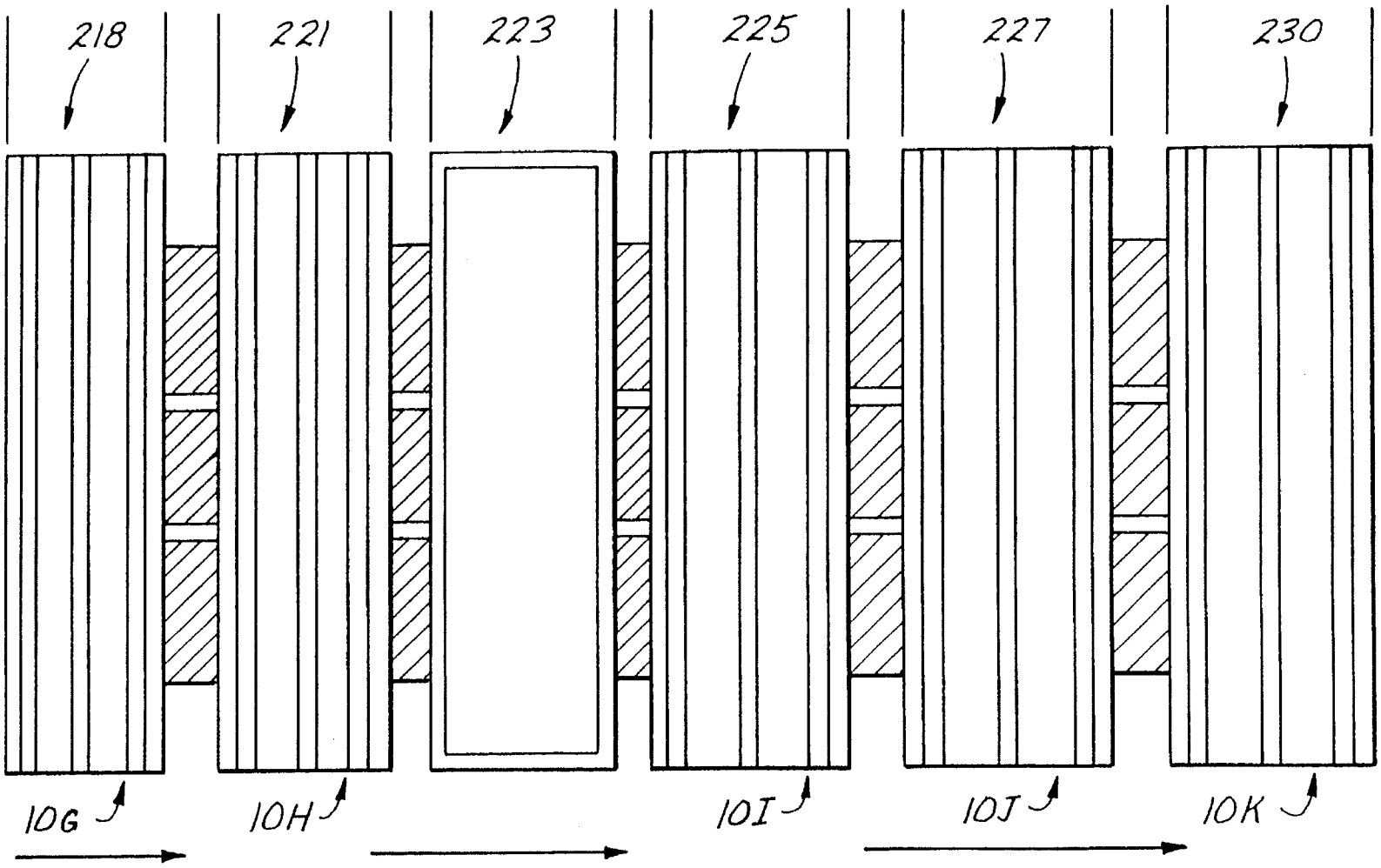
FIG. 15 is a schematic block diagram of a turbine having multiple stages performing different functions where different embodiment of the assembly are included in each stage.

FIG. 15 illustrates a turbine 216 which has multiple stages 218–230. Thus the turbine 216 might include a first compressor in stage 218, a second compressor in stage 221 and a combustion chamber in stage 223. A first turbine might be included in stage 225, a second turbine in stage 227 and a third turbine in stage 230.

Taking advantage of the fact that a given chamber assembly 10 can be adapted to function as either a compressor or a turbine, the first stage 218 may include a chamber assembly 10*g* functioning as a first compressor while the second stage 221 includes a chamber assembly 10*h* functioning as a second compressor. Separate chamber assemblies 10*i*–10*k* could be adapted to function as turbines in the respective stages 225–230. In operation, an air intake into the first stage 218 would be compressed into the chamber assembly 10*g* and further compressed in the chamber assembly 10*h*. This compressed air would then be heated in the combustion stage 223 and permitted to expand through the assemblies 10*i*–10*k* in the turbine stages 225–230, respectively.

Figure 16:
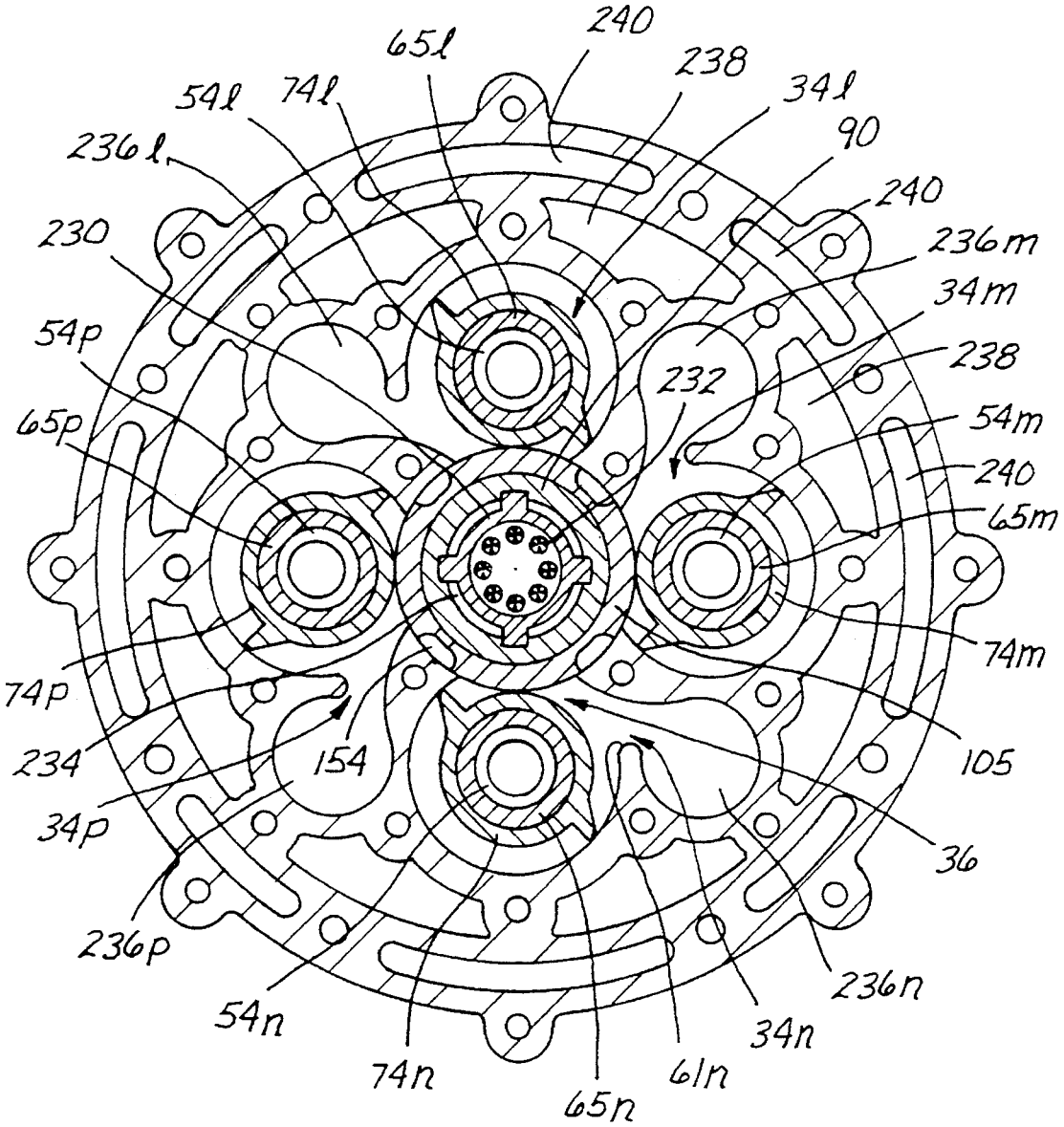
FIG. 16 is a radial cross-section view of a further embodiment of the invention including multiple rotors, a single rotary block, and an internal combustion chamber.

A further embodiment of the invention is illustrated in the cross-section view of FIG. 16. This embodiment is similar to that illustrated in FIG. 14 in that it includes four working sections 34*l*–34*p*, each including an associated rotor 74*l*–74*p*, an associated rotary shaft 65*l*–65*p*, and an associated stationary shaft 54*l*–54*p*. The four rotor sections 34*l*–34*p* rotate with respect to a single common block section 36 which includes the rotary block 105 and a plurality of recesses 154.

The block 105 rotates relative to the stationary shaft 90 which has a hollow configuration in this embodiment. Disposed within the shaft 90 is a burner housing 230 and a plurality of burners 232 which form a combustion chamber 234. This combustion chamber 234 functions in the overall cycle as the combustion stage designated by the reference numeral 223 in FIG. 15. Thus, compressed air can be introduced into the burner housing 230 and heated by the burners 232 to expand into the various rotor sections 34*l*–34*p*. The combustion chamber 234 can then be connected through a common manifold (not shown) to introduce the expanding gases into the channels provided by the stationary shafts 54*l*–54*p*. From these locations, the energy of the expanded gases can be converted into rotation of the rotors 74*l*–74*p* and exhausted through exhaust ports 61*l*–61*p* into associated exhaust chambers 236*l*–236*p*. The exhaust in the chambers 236*l*–236*p* can then be collected by a manifold (not shown) or otherwise exhausted to the environment.

The embodiment of FIG. 16 also includes a series of peripheral ports 238*l*–238*p* as well as a series of circumferential ports 240*l*–240*p* which extend axially of the turbine. These ports 238 and 240 can be used for communicating fluids to and from the rotor sections 34*l*–34*p* and the block section 36. For example, the ports 238, 240 can be adapted to receive and deliver a cooling medium, or air, or fuel. In either case, these fluids would draw heat from the respective rotor and block sections 34 and 36. In the case of a cooling medium, a liquid could be exchanged through the ports 288, 240 and externally cooled to dissipate heat from the turbine. When air or fuel is introduced through the ports 238 or 240, heat exchange may also occur in order to enhance combustion in the chamber 234.

In addition to the ports 238, 240 other ports (not shown) may be provided for lubrication, waste gas elimination, or other fluid medium conduction. These ports will typically be formed in the stationary element in accordance with standard practices known in the art.

In the foregoing embodiments of the invention, the chamber assembly 10 has been described to include a single rotor 74 and a single rotary block 105. As noted, this assembly can be adapted to function in many capacities, such as an engine (for example a turbine), a pump/compressor, or a vacuum pump. These individual chamber assemblies 10 can be combined as disclosed with reference to FIGS. 12–16, to provide an increased output.

In a further embodiment of the chamber assembly 10 illustrated in FIG. 17, similar components are designated by the same reference numeral followed by the lower case letter "q". In this embodiment of the chamber assembly 10*q*, the block section 36 described with reference to FIG. 1 is replaced with a second rotor section 250. Thus the chamber assembly 10*q* has two rotors which provide motive force and function simultaneous as well as synergistically.

In the embodiment of FIG. 17, the rotor section 34*q* is similar to that described with reference to FIG. 9. This section 34*q* includes that part of the housing 12*q* which has the inner surface 125*q* disposed about the axis 38. The hollow stationary shaft 54*q* includes the port 156*q* as previously described.

Rotatable on the stationary shaft 54*q* is the rotary shaft 55*q* which includes a port 158*q* and a port 174*q*. The rotor 74*q* is fixed to the rotary shaft 54*q* and is therefore rotatable with the shaft 65*q* about the stationary shaft 54*q*. As described with reference to FIG. 9, the rotor 74*q* includes a vane 136*q* and a vane 170*q*. A port 161*q* in the rotor 74*q* registers with the port 158*q* of the shaft 65*q* in proximity to the vane 136*q*. Similarly, the port 172*q* of the rotor 74*q* registers with the port 174*q* of the shaft 65*q* in proximity to the vane 170*q*.

In the manner previously discussed, a pressurized fluid entering the hollow shaft 54*q* passes consecutively through the ports 156*q*, 158*q* and 161*q* to exert a pressure on the vane 136*q* thereby causing the rotor 174*q* to rotate in the counterclockwise direction. The pressurized fluid expands within the chamber 141*q* and is ultimately exhausted through the exhaust port 161*q* in the manner previously discussed.

On the opposite side of the chamber assembly 10*q*, the second rotor section 250 differs considerably from the block section 36 described with reference to FIG. 4. The second rotor section 250 is most similar to the first rotor section 34*q* except that it includes an inner surface 251 which is formed about the axis 41*q*. It also includes a hollow stationary shaft 252 having a port 254. A rotary shaft 256, which include ports 258 and 261, is rotatable on the stationary shaft 252. A rotor 263 is fixed to the shaft 256 and therefore rotates about the stationary shaft 252 and the axis 41*q*.

The rotor 263 has an outer surface 265 with a diameter less than the inner surface 251 of the housing 12*q*. As was the case with the rotor 74*q*, a pair of vanes 267 and 270 are provided and extend from the outer surface 265 into proximity with the inner surface 261. In this particular embodiment, the vanes 267, 270 define with the rotor 263 a pair of ports 272 and 274, respectively. These ports 272, 274 register with the ports 258 and 261 respectively of the rotary shaft 256.

In operation, the rotor 263 rotates in a clock-wise direction. As the vane 270 rotates beyond the opening 130*q*, the ports 261 and 274 align with the port 254. A pressurized fluid introduced through the hollow shaft 252 passes through the aligned ports and into a chamber 276 which is defined by the vane 270 and the surfaces 251 and 265.

The synergy of this particular embodiment is of particular interest. It will be noted that the ports 272 and 274 in the rotor 263 function as recesses, such as those designated by the reference numerals 154 and 176 in FIG. 9. The rotors 74*q* and 263 are mounted so that their respective outer surfaces 134*q* and 265 move in to close proximity in the opening 130*q*. Since the vanes 136*q*, 170*q*, 267 and 270 extend outwardly of these surfaces, it is necessary to provide recesses or voids in the opposing rotor in order to accommodate these vanes. In the embodiment of FIG. 9, the vane 136 was accommodated by a recess 154. In the embodiment of FIG. 17, however, the port 272 can function as this recess. Similarly, the port 274 of the rotor 263 is disposed to function as a recess for the vane 270*q*. Although the ports 272, 274 in this embodiment serve the dual function of an intake channel as well as a recess for the vanes 136*q*, 220*q*, it may be desirable in other embodiments to separate these functions. In such a case, a separate recess can be formed for each vane as illustrated in FIG. 9.

In the embodiment of FIG. 17, similar recesses must also be provided for the vanes 267 and 270 of the rotor 263. Thus a recess 278 is provided in the rotor 74*q* to accommodate the vane 267. Similarly, a recess 281 is provided in the rotor 74*q* to accommodate the vane 270.

With respect to the rotor 74*q*, the leading edge of the vane 136*q* (that surface which faces toward the direction of rotation) defines the recess 278 while the trailing surface (that surface which faces away from the direction of rotation) of the vane 136*q* defines the port 161*q*. With respect to the rotor 263, the port 272 functions as a recess for the vane 136*q* and no further recess is required. Within the ports 161*q* and 272 the pressurized fluids from the respective shafts 54*q* and 252 co-mingle and create a common force against the trailing surfaces of the vanes 136*q* and 267.

As the rotors 74*q* and 263 rotate in opposite directions, the associated vanes 136*q* and 267 also rotate expanding the associated chambers 141*q* and 276 which combine to form a single expansive chamber in the assembly 10*q*. This combined chamber 41*q*, 276 expands as the rotors rotate until the vanes 170*q* and 270 are brought into juxtaposition. Then a new intake of the pressurized fluid acts against these vanes to continue the rotation. The energy of the pressurized fluid against the vanes 136*q* and 267 is substantially depleted at this point and the leading edge of these vanes forces the exhaust out the port 161*q*.

The motive force associated with this embodiment is generally twice that associated with the embodiment of FIG. 9 since the pressurized fluid produces a force against substantially twice the surface area.

A further embodiment of the invention is illustrated in FIG. 18. This embodiment is similar to that previously discussed with reference to FIG. 17 except that the shaft 54*q* in the first rotor section 34*q* is not ported and is not relied on for the introduction of the pressurized fluid. Accordingly there is no port associated with the rotary shaft 65*q* and no port associated with either of the vanes 136*q* or 170*q*. With these exceptions, the embodiments of FIGS. 17 and 18 are substantially the same. Nevertheless, they function in a slightly different manner. When the vanes 136*q* and 267 pass their closest point of proximity, as illustrated in FIG. 18, the pressurized fluid passes through the port 254 of the stationary shaft 252 and the ports 258 and 272. Since the respective chambers 141*q* and 276 combine to form a single expansion chamber, the pressurized fluid from the statonary shaft 252 fills both these chambers and provides the same motive force against the vanes 136*q* and 267.

Figure 19:
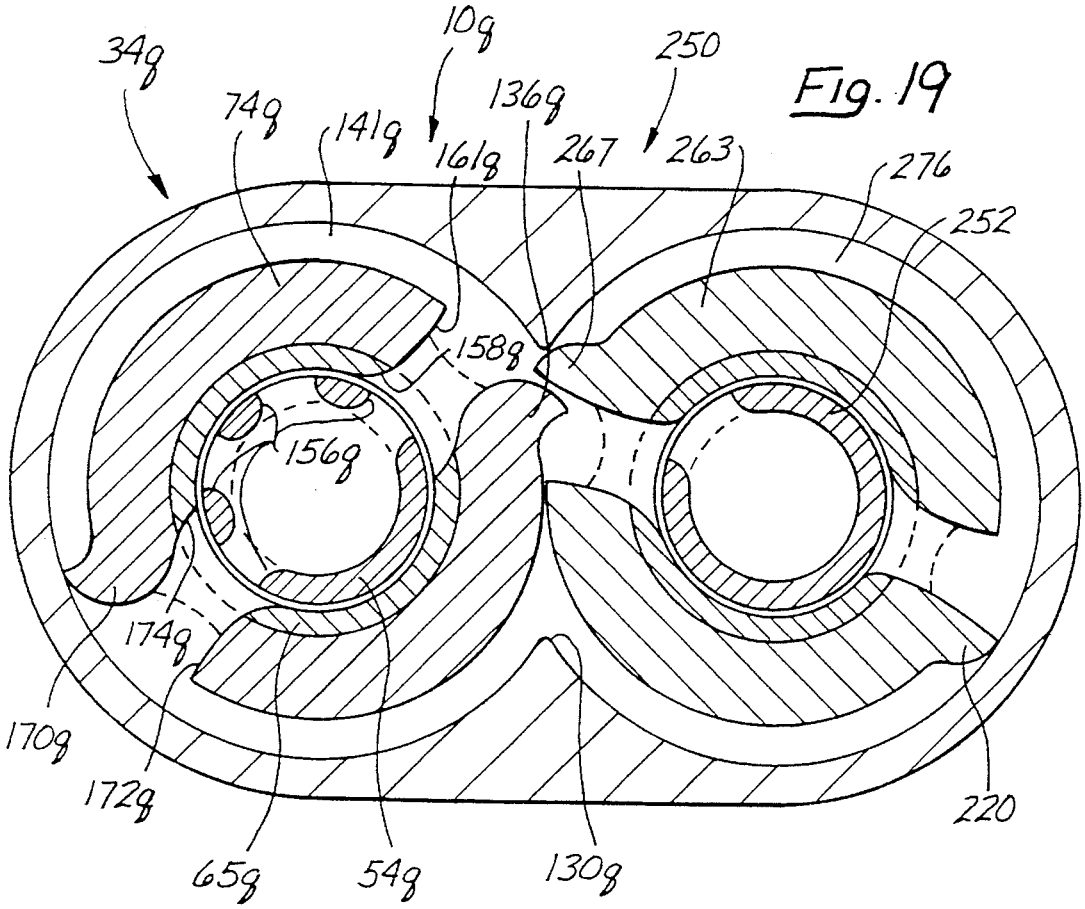
FIG. 19 is a radial cross-section view similar to FIG. 17 wherein one of the rotors revolve rotating about an intake channel and the other rotor revolves about an exhaust channel.

A further embodiment containing the two rotors 74*q* and 263 is illustrated in FIG. 19. In this embodiment, the stationary shaft 54*q* is formed with a plurality of the ports 156*q* which are equally spaced around less than the entire circumference of the shaft 54*q*. In the illustrated embodiment, there are four ports 156*q* which are equally sized and spaced around approximately 180° of the circumference of the shaft 54*q*. In the manner previously described with reference to FIG. 17, the rotary shaft 65*q* is provided with ports 158*q* and 174*q*. Similarly, the rotor 74*q* is formed with the ports 161*q* and 172*q*. Importantly, the vanes 136*q* and 170*q* of this embodiment are positioned on the trailing side of the associated ports. Thus it can be seen in FIG. 19 that the leading surface rather than the trailing surface of the vane 136*q* forms the port 161*q*. Similarly, the leading surface rather than the trailing surface of the vane 170*q* forms the port 172*q*.

In this embodiment, the port 161*q* of the rotor 174*q* provides the recess for the vane 267 of the rotor 263. Similarly, the port 172*q* of the rotor 74*q* provides the recess for the vane 270 of the rotor 263.

With this configuration, the housing 12*q* does not contain an exhaust port such as that designated by the reference numeral 163 in FIG. 17. Rather, the stationary shaft 54*q* functions as an exhaust port for the chamber assembly 10*q*. In operation, the vanes 136*q* and 267 move beyond their point of closest proximity illustrated in FIG. 19 and the pressurized fluid from the stationary shaft 252 fills the expanding combined chamber 141*q*, 276. The force of this pressurized fluid is exerted against the trailing surface of the vanes 136*q*, 267 in the manner previously discussed.

As the rotors 74*q* and 263 revolve, the energy in the pressurized gas is depleted in the expanding chamber 141*q*, 276. When the vanes 236*q* and 267 have moved approximately 180°, the port 172*q* moves into and beyond the opening 130*q* thereby gaining access to the chamber 141*q*, 276. At this point, the exhaust gasses from the prior expansion pass into the port 172*q* and through the ports 174*q* and 156*q* into the central channel of the stationary rotor 54*q*. In this embodiment, it can be seen that the shaft 54*q* of the rotor section 34*q* functions as an exhaust conduit while the shaft 252 of the second rotor section 250 functions as an intake conduit.

It can be appreciated that the concept of the present invention can be embodied in a single unit including at least one, such as the rotor 74 and perhaps a block, such as the rotary block 105. This unit can be adapted to function as an engine, such as a turbine, a pump/compressor, or a vacuum pump. The single units can be combined with multiple rotor sections 34 operating off of a single block section 36. These sections can be similarly combined to form banks of the chamber assemblies to multiply the effect of the individual units.

Given the wide variations, which are all within the scope of this concept, one is cautioned not to restrict the invention to the embodiments which have been specifically disclosed and illustrated, but rather encouraged to determine the scope of the invention only with reference to the following claims.

I claim:

1. An apparatus defining an expansible/contractible chamber, comprising:

a housing including a first housing portion and a second housing portion, the first housing portion having a first axis and an inner surface with a first radius, the second housing portion having a second axis and an inner surface with a second radius;

a first rotor rotatable about the first axis within the first housing portion, the first rotor having a hollow center and an outer surface with a third radius less than the first radius of the first housing portion;

a second rotor rotatable about the second axis within the second housing portion, the second rotor having a hollow center and an outer surface with a fourth radius less than the second radius of the second housing portion;

at least one first vane carried by the first rotor and extending radially outwardly of the outer surface of the first rotor toward the inner surface of the first housing portion;

at least one second vane carried by the second rotor and extending radially outwardly of the outer surface of the second rotor toward the inner surface of the second housing portion;

portions of the first vane defining a first section of the expansible/contractible chamber, the first section of the chamber having a volume variable with the angular position of the first rotor relative to the first housing portion;

portions of the second vane defining a second section of the expansible/contractible chamber, the second section of the chamber having a volume variable with the angular position of the second rotor relative to the second housing portion;

a first portion of the first rotor defining a first recess sized and configured to receive the at least one second vane carried by the second rotor;

a first portion of the second rotor defining a second recess sized and configured to receive the at least one first vane carried by the first rotor;

the first recess being closed and extending less than the entire distance between the outer surface of the first rotor and the hollow center of the first rotor;

and the second recess being open and extending the entire distance between the outer surface of the second rotor and the hollow center of the second rotor, the second recess providing an intake port for the expansible/contractible chamber; and a second portion of the first rotor disposed on the side of the first vane opposite the first recess and defining a third recess, the third recess being open and extending the entire distance from the outer surface of the first rotor to the hollow center of the first rotor and providing an exhaust port for the expansible/contractible chamber;

a first stationary shaft disposed concentric with the first axis having a fixed relationship with the housing, the first rotor being rotatable about said first stationary shaft;

a second stationary shaft concentric with the second axis and having a fixed relationship with the housing, the second rotor being rotatable about said second stationary shaft;

the first stationary shaft being hollow and defining a first lateral opening extending into the third recess, the first lateral opening forming with the third recess the exhaust port of the expansible/contractible chamber; and the second stationary shaft being hollow and defining a second lateral opening extending into the second recess, the second lateral opening defining with the second recess the intake port of the expansible/contractible chamber;

a third shaft disposed concentric with the first shaft about the first axis and having a rotatable relationship with the first shaft;

a fourth shaft disposed concentric with the second shaft about the second axis and having a rotatable relationship with the second shaft;

means providing the third shaft with a fixed relationship to the first rotor;

and means providing the fourth shaft with a fixed relationship to the second rotor;

2. The apparatus recited in claim 1 wherein:

the means for maintaining the third shaft in a fixed relationship with the first rotor comprises a first set of splines extending axially between the third shaft and the first rotor; and the means for maintaining the fourth shaft in a fixed relationship with the second rotor comprises a second set of splines extending axially between the fourth shaft and the second rotor.

* * * * *